US009410300B2

(12) United States Patent
Atilano et al.

(10) Patent No.: US 9,410,300 B2
(45) Date of Patent: Aug. 9, 2016

(54) MODULAR SUBMERGIBLE BREAKWATER FOR LOWERING WATER WAVE KINETIC ENERGY ESPECIALLY DURING STORMS OR ROUGH WATERS

(71) Applicant: INNOVATION AND DEVELOPMENT LLC, Pembroke Pines, FL (US)

(72) Inventors: Alvaro Atilano, Caracas (VE); Victor Blanco, Maracay (VE); Jose Rodriguez, Caracas (VE); Leonella Rodriguez Dotti, Caracas (VE)

(73) Assignee: INNOVATION AND DEVELOPMENT LLC, Pembroke Pines, FL (US)

( * ) Notice: Subject to any disclaimer, the term of this patent is extended or adjusted under 35 U.S.C. 154(b) by 141 days.

(21) Appl. No.: 14/277,459

(22) Filed: May 14, 2014

(65) Prior Publication Data

US 2015/0259869 A1 Sep. 17, 2015

Related U.S. Application Data

(60) Provisional application No. 61/953,209, filed on Mar. 14, 2014.

(51) Int. Cl.
*E02B 3/06* (2006.01)

(52) U.S. Cl.
CPC ..... *E02B 3/062* (2013.01)

(58) Field of Classification Search
CPC ..... E02B 3/04; E02B 3/06; E02B 3/062
USPC ..... 405/21, 25, 26, 27, 28, 30, 35
See application file for complete search history.

(56) References Cited

U.S. PATENT DOCUMENTS

| | | | | | |
|---|---|---|---|---|---|
| 226,772 | A | * | 4/1880 | Mueller | 405/28 |
| 762,727 | A | * | 6/1904 | Landenberger, Jr. | 405/35 |
| 1,264,756 | A | * | 4/1918 | Begg | 405/22 |
| 1,385,166 | A | * | 7/1921 | Bagnall | 405/27 |
| 2,584,867 | A | * | 2/1952 | Guarin | 405/23 |
| 3,011,316 | A | * | 12/1961 | Wilson | 405/28 |
| 3,214,916 | A | * | 11/1965 | Martin | 405/28 |

(Continued)

OTHER PUBLICATIONS

Botts et al, Corelogic Storm Surge Report, 2013.

(Continued)

*Primary Examiner* — Benjamin Fiorello
*Assistant Examiner* — Aaron Lembo
(74) *Attorney, Agent, or Firm* — Robert Platt Bell

(57) ABSTRACT

The present invention relates to submergible modular breakwaters for lowering the kinetic energy of water waves. In particular, the present invention is directed toward a physical embodiment that, when in its floating position, will provide resistance to the movement of water waves in the direction of the waves for a large range of wave periods. The invention is a submergible modular breakwater that can be kept underwater on the sea or lake floor as not to provide any barrier to navigation until it is needed to lower the kinetic energy of waves, when it is quickly raised afloat to provide protection, especially for coastal erosion control during storms or rough waters. Once the lowering of the kinetic energy of water waves is not longer needed, the modular breakwater can be quickly sunk to the sea or lake floor in order to remove any barrier to navigation.

18 Claims, 21 Drawing Sheets

(56) References Cited

U.S. PATENT DOCUMENTS

| | | | | |
|---|---|---|---|---|
| 3,785,159 | A * | 1/1974 | Hammond | 405/77 |
| 3,952,521 | A * | 4/1976 | Potter | 405/27 |
| 4,027,486 | A * | 6/1977 | Dougherty | 405/27 |
| 4,089,179 | A * | 5/1978 | Trautman | 405/74 |
| 4,098,086 | A * | 7/1978 | Desty et al. | 405/26 |
| 4,216,655 | A * | 8/1980 | Ghesquiere | 60/398 |
| 4,234,266 | A * | 11/1980 | Angioletti | 405/26 |
| 4,647,249 | A * | 3/1987 | Grooms | 405/28 |
| 4,671,495 | A * | 6/1987 | Garland et al. | 256/12.5 |
| 4,715,744 | A * | 12/1987 | Richey | 405/26 |
| 4,997,310 | A * | 3/1991 | Rasmussen | 405/26 |
| 5,509,755 | A * | 4/1996 | Olsen et al. | 405/21 |
| 5,707,172 | A * | 1/1998 | Wilcox | 405/26 |
| 5,888,020 | A * | 3/1999 | Brais et al. | 405/28 |
| 6,431,792 | B1 * | 8/2002 | Barnes | 405/25 |
| 6,935,808 | B1 * | 8/2005 | Dempster | 405/28 |
| 7,736,089 | B2 * | 6/2010 | Brais | 405/28 |
| 7,857,291 | B2 * | 12/2010 | Dombroski | 256/24 |
| 8,747,023 | B1 * | 6/2014 | Walker | 405/21 |
| 8,950,975 | B2 * | 2/2015 | Nettles | 405/21 |
| 2002/0110422 | A1 * | 8/2002 | Hulsemann | 405/25 |
| 2003/0147696 | A1 * | 8/2003 | Hulsemann et al. | 405/21 |
| 2005/0058509 | A1 * | 3/2005 | Steinberg | 405/34 |
| 2005/0271470 | A1 * | 12/2005 | Rytand | 405/21 |
| 2006/0078385 | A1 * | 4/2006 | Watchorn | 405/23 |
| 2006/0216115 | A1 * | 9/2006 | Cho et al. | 405/30 |
| 2009/0154996 | A1 * | 6/2009 | Liner | 405/35 |
| 2010/0178109 | A1 * | 7/2010 | Wilson | 405/27 |
| 2010/0196098 | A1 * | 8/2010 | Danskine et al. | 405/25 |
| 2011/0002739 | A1 * | 1/2011 | Howland | 405/26 |
| 2013/0170909 | A1 * | 7/2013 | Osby et al. | 405/26 |
| 2014/0161532 | A1 * | 6/2014 | McCormick et al. | 405/26 |
| 2014/0183122 | A1 * | 7/2014 | Canals et al. | 210/251 |
| 2014/0369755 | A1 * | 12/2014 | Jansen et al. | 405/26 |
| 2015/0063910 | A1 * | 3/2015 | Meltsov et al. | 405/21 |
| 2015/0132062 | A1 * | 5/2015 | Danenhower | 405/30 |

OTHER PUBLICATIONS

"Beach Replenishment", 2010 Environmental Trends, New Jersey Department of Environmental Protection, Office of Science, http://www.nj.gov/dep/dsr/trends/ pdfs/beach-replenish.pdf, 2010.

Margaree Consultants Inc. Assessment of the Economic Impact of Climate Change on CARICOM Countries, 2002.

Low-Carbon Climate-Resilient Development Strategy—2012—2020.

"Environment and development in coastal regions and in small islands", UNESCO http://www.unesco.org/ csi/act/cosalc/hur9b.htm, printed Mar. 21, 2014.

* cited by examiner

MODULAR SUBMERGIBLE BREAKWATER FOR LOWERING WATER WAVE KINETIC ENERGY ESPECIALLY DURING STORMS OR ROUGH WATERS

CROSS-REFERENCE TO RELATED APPLICATIONS

The present application claims priority from Provisional U.S. Patent Application No. 61/953,209 filed on Mar. 14, 2014, and incorporated herein by reference.

FIELD OF THE INVENTION

The present invention relates to submergible modular breakwaters for lowering the kinetic energy of water waves. In particular, the present invention is directed toward a physical embodiment that, when in its floating position, will provide resistance to the movement of water waves in the direction of the waves for a large range of wave periods.

BACKGROUND OF THE INVENTION

Recently, partly due to changes influenced by climate change such as sea raise and stronger storms, there have been major catastrophes in coastal areas in the world both in industrialized temperate weather countries and in non-industrialized tropical countries. An example of a catastrophe in an industrialized temperate weather country was the one caused by Hurricane Sandy in the East Coast of the United States, one of the costliest catastrophes in the history of this country. During storms, the principal damages caused by water waves are erosion, especially by the removal of sand in sandy beaches, destruction of infrastructure close to the coastline, and flooding. Strong storms or rough waters in coastal areas have both direct and indirect economic and financial negative impacts. The direct economic and financial impact results from the urgent necessity to repair damage and to restore conditions of the coastline beaches and infrastructures.

As quoted in the 2013 Corelogic Storm Surge Report, " . . . For many homeowners along the eastern seaboard of the United States, Hurricanes Irene and Sandy have been harsh reminders that hurricane risk in not simply confined to Florida or even just the southern states. Hurricane Irene arrived during the late summer of 2011 and caused more than $15 billion in property damage. The impact zone included 13 states and extended as far north as Vermont and New Hampshire, becoming the seventh costliest hurricane in U.S. history. As it turns out, however, Irene was a weak opening act for what was to come in 2012. Hurricane Sandy dwarfed the property damage caused by Irene just one year prior when its devastating storm surge struck the northeastern coastline in late October. As the storm barreled along the Atlantic coast, Sandy set records for surge water and wave heights in New York, New Jersey and Connecticut. The destruction attributed to this single storm is estimated at $50 billion, with some 650,000 home damaged or destroyed, and caused power outages in the Northeast affecting 8.5 million people."

One of the indirect negative economic impacts, especially in coastal zones of tourist states like for example Florida and New Jersey, are reduction of tourism activities along after the passing of the storm. To have an idea of the importance of economic benefits derived from beaches in a tourist state like New Jersey, the following can be quoted from a 2010 Environmental Trends Report titled "Beach Replenishment" of the New Jersey Department of Environmental Protection, Office of Science (http://www.nj.gov/dep/dsr/trends/pdfs/beach-replenish.pdf, incorporated herein by reference) ". . . New Jersey's beaches play a critical role in protecting people and property from coastal storm hazards. Due to its geography, New Jersey is sometimes in the path of hurricanes (tropical storms) and nor'easters (extratropical storms). Beaches act as a buffer between the surf and the homes, businesses and infrastructure along the coast. In addition, beaches provide recreation for beachgoers and fishermen and help support a multibillion dollar tourism industry. In 2008, the total economic impact of travel and tourism was $27.9 billion to the state, which accounted for 5.8 percent of the gross state product. In addition, 72 percent of each tourism dollar spent in New Jersey was retained in state, and 10.9 percent of the total employment in the state, 443,094 jobs, was due to travel and tourism economic activity. In 2008, tourism generated $7.7 billion in federal, state, and local government taxes. A regional breakdown of tourism shows that 33.4 percent of total statewide tourism expenditure occurs in Atlantic County, with the Southern Shore Region (Cape May and Cumberland counties) and the Shore Region (Monmouth and Ocean counties), contributing 14.5 percent and 13.9 percent respectively. In addition, Atlantic, Cape May, and Ocean counties are leaders in terms of tourism expenditure by county; these three counties combined contribute over half of New Jersey's total tourism expenditure." After hurricanes like Irene and Sandy, the importance of coastal protection in coastal urban and tourist zones has never greater than today.

In the case of tropical countries, especially small island countries, climate change derived destruction, through sea raise and stronger storms, will heavily impact the economy of such countries. For example, as stated in a report prepared by Margaree Consultants Inc. for the World Bank in 2002 (Assessment of the Economic Impact of Climate Change on CARICOM Countries, incorporated herein by reference) ". . . In most of the eastern Caribbean states, more than 50% of the population resides within 2 km of the coast. Thus large populations and supporting infrastructure are located close to mean sea level. As a result critical infrastructure tends to be located in or near coastal areas. The projected sea-level rise will increase the vulnerability of that infrastructure, especially during extreme events. Due to the concentration of population in these areas, damage to important infrastructure may be disruptive to economic, social and cultural activities. The Caribbean region suffered considerable damage from severe hurricanes in the 1980s and 1990s. As a direct result, many insurance and reinsurance companies withdrew from the market. Those that remained imposed onerous conditions for coverage—including very high deductibles; separate, increased rates for windstorms; and insertion of an "average" clause to eliminate the possibility of underinsurance . . . "

"Hurricane and tropical storm activity have had major impacts on Antigua and Barbuda's vital tourism industry. In 1995 Hurricanes Luis and Marilyn devastated coastal areas, causing severe damage to hotel and other tourism properties and leading to a 17% decrease in the number of tourist arrivals and adversely affecting employment and foreign exchange. The cost associated with damage from Hurricane Gilbert in 1988 was in the region of J$25 million. The 1998 hurricane season was especially devastating to Jamaica with long lasting effects resulting from hurricanes Georges and Mitch. Hurricane Lenny in 1999 caused approximately US$250, 000.00 damage to tourism infrastructure in Dominica, mainly along the west coast. Tourism arrivals in St. Kitts by air and sea have been negatively affected by the passage of hurricanes Luis and Marilyn (1995), Georges (1998) and Jose (1999). Lost stay over tourist days in St. Lucia were estimated at 50% due to hurricane Allen."

The report entitled, "Low-Carbon Climate-Resilient Development Strategy—2012-2020" incorporated herein by reference, states ". . . It is well-established that the countries of the Caribbean are among the most vulnerable to global climate change. While the severity of the impacts will vary from country to country, there is a suite of priority concerns directly linked to climate change that is virtually ubiquitous across the region. Sea level rise will combine a number of factors resulting in accelerated coastal erosion, increased flood risk and in some areas permanent loss of land. This may be exacerbated further by any increase in the destructiveness of tropical storms, the impacts of which may be greater due to sea-level rise even without increases in storm intensity."

An example of the impacts of sea waves on beaches is presented in the UNESCO portal Environment and development in coastal regions and in small islands (http://www.unesco.org/csi/act/cosalc/hur9b.htm, incorporated herein by reference), where the impacts that tropical storm waves had in Dominica is described as follows: ". . . Tropical Storm Iris passed 30 km west of Dominica, Hurricane Luis passed 180 km north of Dominica and Hurricane Marilyn passed less than 20 km east of the island. All three storms impacted Dominica, but Hurricane Marilyn was the strongest and closest. The combined damage from the three storm systems was estimated at US$184 million . . . " ". . . Tropical Storm Iris damaged the west coast road and cut road access between Soufriere and Scotts Head. Hurricane Luis damaged coastal structures—hotels, roads, utilities, jetties and fish landing sites. There was severe damage to the beaches, especially on the west coast. In particular the northwest beaches from Prince Rupert Bay to Toucarie were heavily impacted. The road was washed out and the hotel damaged at Coconut Beach, similar damage occurred at Mero. Trees were undermined and washed away, and in some cases—Toucarie, Belle Hall and Mero—the sand was replaced with stones and boulders. At some sites such as Batalie, debris from the reefs was washed up onto the beach. New beachrock formations were exposed at some of the beaches e.g. Woodford Hill. The data show that the erosion was most severe on the west coast beaches particularly at Rockaway Beach, Mero Beach, Coconut Beach and Purple Turtle. The profile area decreased by 24%, the beaches narrowed by 6.7 m and the land edge retreated inland 2.4 m."

For decades there have been many devices proposed and used to control force of water waves (in seas and lakes) that reach coasts and cause severe damage including erosion of beaches, flooding, destruction of buildings and boardwalk, and the like. These devices include seawalls, bulkhead, and breakwaters. In the case of breakwaters, they can be fixed caissons either submerged or that raise above the water line, or modular structures that can be fixed to the sea bed by piling or floating components anchored.

Fixed breakwaters, generally constructed with rocks, can be expensive to build especially when the water depth is more than 5 meters. Additional disadvantages of this type of breakwater, beside costs, are affectation of the beach view, and the accumulation of sand between the breakwater and the coastline.

Many modular breakwaters that consist of laminar components (like walls, plates or sheets) that block the horizontal movement of water waves are placed in location by piling. Revision of previous art indicates that this type of breakwaters can be impractical due to the following characteristics:

a) They protrude from the water all the time, creating a possible navigating hazard;
b) They are difficult to place on the water. To attach a breakwater to the bottom may require piling, making the deployment very costly; and
c) Water wave kinetic forces during storms could easily destroy this type of breakwater, due to the forces exert in the base of the pilings.

Prior Art floating breakwaters, have other disadvantages:

a) They do not extend like a wall through the entire water column; therefore protection in the horizontal plane is not complete;
b) They stay afloat all the time, creating possible navigating hazards;
c) Due to the linear and/or cylindrical shape and the small diameter of the main components of such devices, a large number of units must be deployed in order to block the horizontal movement of water waves;
d) Even though Stokes Law movement of the water molecules keeps pushing these floating devices towards the coast, the circular or elliptical movement of the molecules during the passing of waves also makes these devices move in a circular or elliptical manner. This movement makes the barrier less efficient in stopping kinetic energy movement toward the coast due to the horizontal back-and-forth movement of the devices;
e) Although some of these devices are designed in such a manner as to create more resistance to the movement of water waves and to reduce the back and forth movement when the water waves pass though then, for example by placing plates or components a half-wavelength distance from each other, these type of designs are impractical to deploy and costly to build due to size (i.e., minimum a half wavelength); and
f) In many cases, these floating breakwaters are composed of many cylindrical units which are independently anchored and, since the diameter of each unit cannot be that large, a lot of anchors are required, as well as time to place them, in order to have an effective horizontal water movement blockage.

A review of the Prior Art indicates that very few of the breakwater devices have been designed to be deployed and act only when major storms or rough waters reach the coast and raised or dissembled once the storm passes. The aforementioned problems or challenges are precisely those which the present invention is oriented to solve.

SUMMARY OF THE INVENTION

The present invention relates to submergible modular breakwaters for lowering the kinetic energy of water waves. In particular, the present invention is directed toward a physical embodiment that, when in its floating position, will provide resistance to the movement of water waves in the direction of the waves for a large range of wave periods. The invention is a submergible modular breakwater that can be kept underwater on the sea or lake floor as not to provide any barrier to navigation until it is needed to lower the kinetic energy of waves, when it is quickly raised afloat to provide protection, especially for coastal erosion control during storms or rough waters. Once the lowering of the kinetic energy of water waves is not longer needed, the modular breakwater can be quickly sunk to the sea or lake floor in order to remove any barrier to navigation.

It is the main objective of the present invention to reduce the kinetic energy of water waves that reach the coastline, especially during storms or rough waters independently of the wave periods or heights.

It is another objective of the present invention to quickly and cheaply be raised from the sea or lake floor or be deployed from the coast to act as a breakwater before waves derived from storms or rough waters states arrive to the coastline.

It is another objective of the present invention to quickly and cheaply be sunk to the sea floor or be removed to the coast to stop acting as a breakwater after waves derived from storms or rough waters states are not longer a threat, eliminating then any navigational barriers.

It is another objective of the present invention to be easily deployable at the appropriate location avoiding the use of large cranes and/or the like.

It is another objective of the present invention to provide a device that may survive harsh weather or high waves.

In order to accomplish these objectives there is provided a modular submergible breakwater device with four main embodiments. All elements or components of the breakwater device can be made of any type of materials, but especially metals like aluminum and/or steel. All embodiments are comprised of a mainframe attached to two or more main floats, at least one of such a floats located at each end of said mainframe in order to make the entire system to float in a catamaran manner. These main floats are attached to the mainframe through a series of legs in a manner as to guarantee structural toughness and survivability during waves derived from storms or rough waters.

An additional stabilizing float may be located at the center of the mainframe with the purpose to maintain the mainframe in a horizontal position while the entire system is being sunk to or raised from the sea or lake bottom. All main floats and stabilizing float are designed of the appropriate size as to guarantee stable flotation of the entire system while being afloat. The principal components that make the breakwater device to act as a breakwater are Venetian-like slats located under the mainframe. These Venetian-like slats will act as a breakwater only in the direction of the wave when they are in a lose stage and the breakwater device is afloat. This occurs because a series of anchor lines hold in position the entire breakwater device and the Venetian-like slats will close under the pressure of the incoming wave.

Once the wave crest passes and the breakwater device is floating in the wave trough, water movement in the opposite direction of the wave is allowed because the Venetian-like slats will open under the pressure of the water moving away from the coast. All the anchor lines, which are attached not only to the mainframe, main floats and Venetian-like slats, also are attached to a single anchor on the sea or lake floor. All main floats have holes in the lowest position as to allow the entrance of water while the breakwater device is being sunk, or the exit of water from the float to the environment while the breakwater device is being raised afloat by filling them with air. The stabilizing float has holes in the lowest possible position as to allow the entrance of water coming from the main floats through connecting lines or hoses while the breakwater device is being sunk, or the exit of water from the float to the main floats while the breakwater device is being raised afloat by filling them with air.

Within the mainframe there is a float air filling system comprising:

a) one or more pressurized air tanks;

b) a dual position valve (one position allows the entrance of air from the pressurized tanks to the stabilizing float and the other position allows air to out from the stabilizing float to the environment) located at the highest point of the stabilizing float;

c) air flow connection lines or hoses that go from the pressurized tanks to the dual position valve at the top of the stabilizing float; and d) air-water flow connection lines or hoses that go from the lowest position of the stabilizing float to the top position of the main floats.

The procedure the sinking of the breakwater device when it is afloat is to put the dual valve in the release air to the environment position. This may allow water to enter the main floats through the holes they have in their lowest position. Once the main floats are filled with water, the water continues to enter the stabilizing float through the air-water connection lines or hoses that connect the top of the main floats with the bottom of the stabilizing float. In order to raise the breakwater device from the sea or lake floor, the reverse procedure is done; that is, the dual valve is put in the fill with air position, allowing air to come from the pressurized tanks to the stabilizing float and then, through the air-water flow lines or hoses that connect the stabilizing float with the main floats, filling with air the main floats. During the float filling process, water inside the floats is released to the environment through the holes located at the lowest position in the main floats.

In a first embodiment of the present invention, a series of breakwater devices may generally remain sunk several meters at a location on top of the sea or lake floor with the Venetian-like slats not acting as a breakwater because they are compressed between the mainframe and the sea or lake floor. In this position, the breakwater devices do not pose any navigational hazard. Once a storm or rough water state is predicted (usually 48 to 72 hours ahead) through usual weather prediction systems and rough water waves are expected in the coastline where the breakwater devices are located, the breakwater devices are raise within a few minutes per device by filling all floats with air. This may allow the Venetian-like slats to hang in their lose embodiment from the mainframe down to the bottom of the sea or lake and act as a unidirectional breakwater. It is important to note that in this embodiment, a number of breakwater devices located to protect several kilometers of coastline can be raised within a few hours, allowing coastal protection to be in place before arrival of predicted rough waves. Once waves are not longer a threat, the breakwater devices, after having the emptied pressured tanks replaced, can be sunk to the bottom of the sea or lake also within a few hours, therefore removing any navigational barrier.

In a second embodiment, the modular breakwater of the present invention is always in a floating position and the raising or lowering of the slats is performed by a mechanism. Since in this embodiment the device is always afloat, there is no need for an air filling system or for a stabilizing float.

In a third embodiment, the modular breakwater of the present invention is always in a floating position and there is no mechanism for raising or lowering of the slats. Since in this embodiment the device is always afloat, there is no need for an air filling system or for a stabilizing float.

In the fourth embodiment, the modular breakwater of the present invention has Venetian-like slats with holes to allow water to pass through when the breakwater is in the wave crest and the slats are closed, creating turbulence during the passing of the water waves. These Venetian-like slats with holes can be used in and embodiment of the device.

In the fifth configuration, ideal when the incident wave angle with respect to the coast is always the same, the modular breakwater of the present invention has an additional anchor and anchor lines between the breakwater and the coast holding in position the entire breakwater device when it is in the wave trough and the water molecules movement is in the opposite direction of the wave.

Dimensions of the device may be varied to suit prevalent sea conditions of the locality where deployed.

The construction of the device is similar to the construction of buoys and small ships and device is thus very robust.

The present invention may bot have a fixed "design wave height" or "design wave period" but may actually have a "design wave height range" and a "design wave period range".

DETAILED DESCRIPTION OF THE INVENTION

The following Figures are not to scale. The actual dimension and/or shape of each of the device components may vary. Only important details of the device are shown, however one of ordinary skill in the art can appreciate how the overall device may be constructed, without undue experimentation. The device may be constructed using standard ship, boat and/or buoy building methods and materials or any appropriate materials and methods to allow efficiency and survivability.

Figure 1:
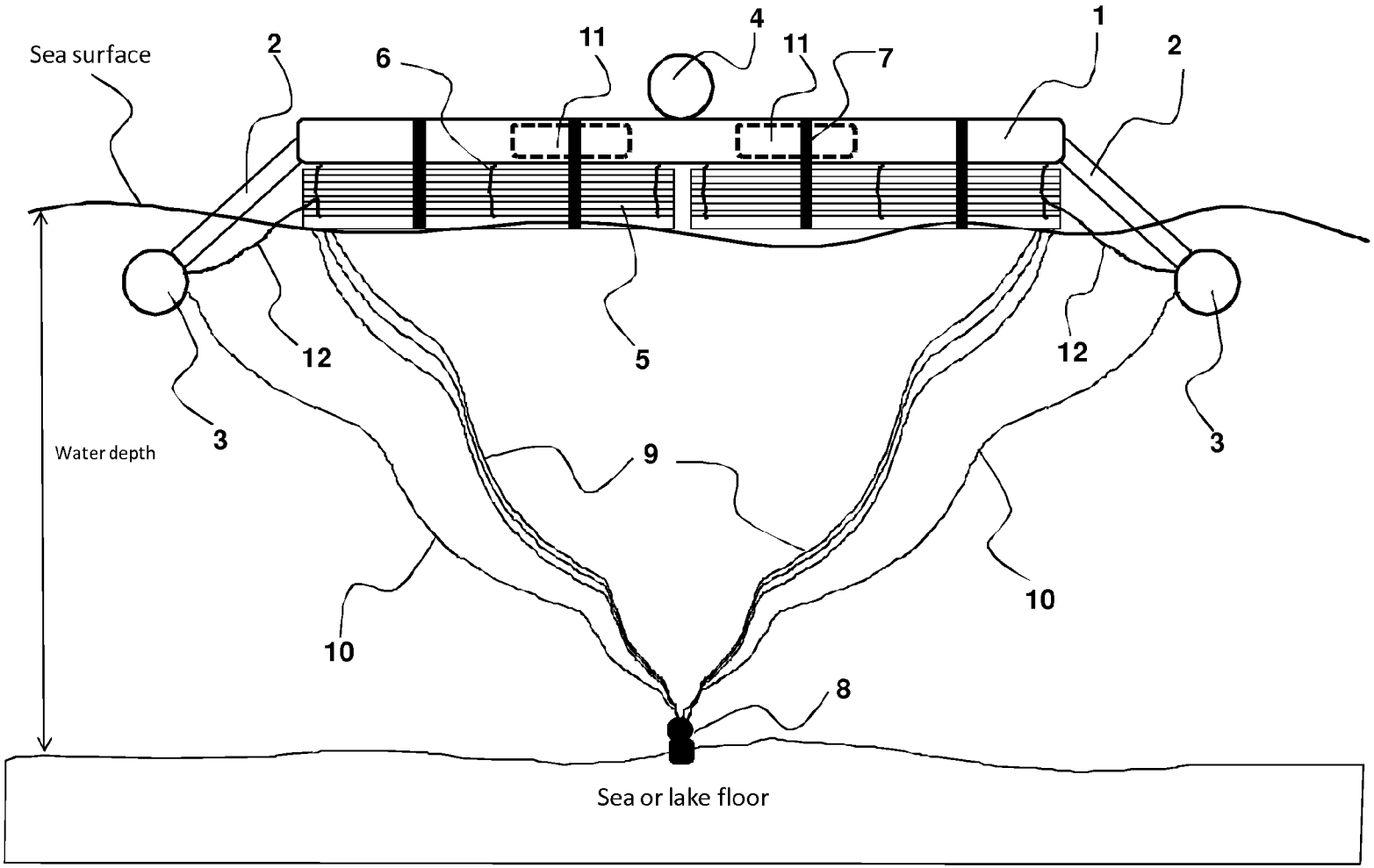
FIG. 1 is a general front view of the first embodiment of the modular breakwater of the present invention in the floating position with the breakwater Venetian-like slats in the raised position.
Figure 2:
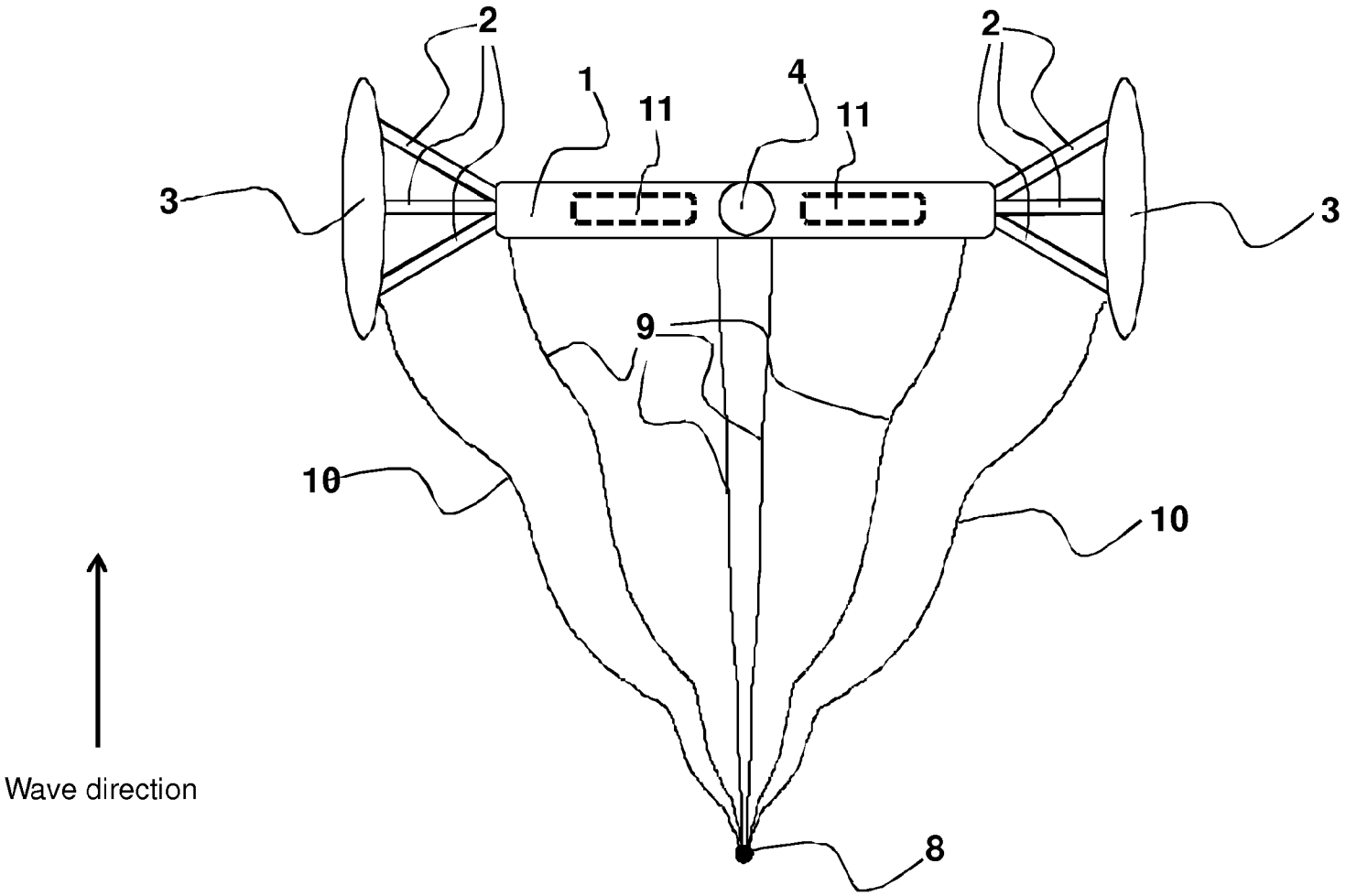
FIG. 2 is a general top view of the first embodiment of the modular breakwater of the present invention.

FIG. 1 is a general front view of the first embodiment of the modular breakwater of the present invention, in the floating position, with the breakwater Venetian-like slats in the raised position. FIG. 2 is a general top view of the first embodiment of the modular breakwater of the present invention. Note the movement and direction of the waves as illustrated in FIG. 2. Referring to FIGS. 1 and 2, the apparatus is composed of a main frame 1 that serves as the structure that holds all parts of the modular breakwater device together. Legs 2 serve as the base for the main floats of the breakwater 3. The main floats 3 are designed in such a manner as to maintain the main frame 1 out of the water when they are completely filled with air, like a catamaran. At the center of main frame 1 is located a stabilizing float 4 which has the purpose to hold the main frame 1 in a horizontal position when the breakwater is being sunk into the seafloor or lifted from the seafloor when it is in its submerged position. The main frame 1 also holds a series of Venetian-like slats 5 which are hold together with lines 6 and which in FIG. 1 are shown in their raised position with ropes, belts or equivalent elements 7. The ropes, belts or equivalent elements 7 are used only when the modular breakwater is being placed in the water for the first time in order to maintain minimum water resistance when dragging or placing the breakwater its permanent position. When the Venetian-like slats are in their unfolded position as is discussed below, they will serve the function of impeding the movement of the water in the direction of the wave shown in FIG. 2, therefore lowering the kinetic energy of waves reaching the coastline.

The modular breakwater is held in position through two sets of anchor lines attached to the breakwater anchor 8. One set of lines 9 is attached in an evenly spaced manner to the lines 6 that hold together the Venetian-like slats, and the other set 10 is attached to the main float 3. Within main frame 1 there are located one or more scuba diving like pressurized air tanks 11 (only two are shown) that are used to fill floats 4 and 3 (in that order).

In FIG. 1 stabilizing lines 12 are also illustrated. The purpose of stabilizing lines 12 is to make sure that when the breakwater floats 3 are being filled with air, they keep these floats always below the mainframe 1 line because the Venetian-like slats 5 add weight to these floats when the slats are in the lowered position.

Figure 3:
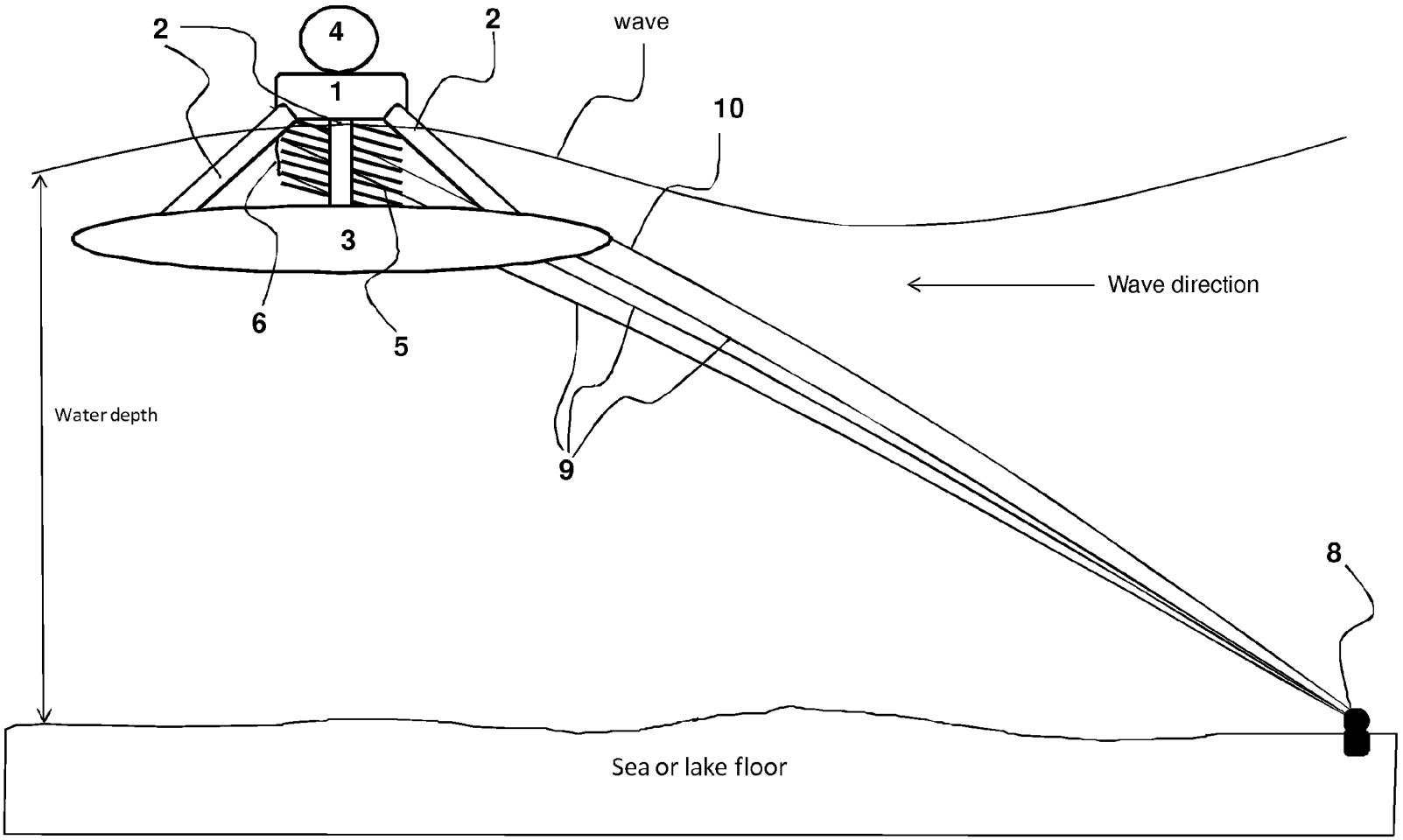
FIG. 3 is a general side view of the first embodiment of the modular breakwater of the present invention in the floating position over a wave crest, with the breakwater Venetian-like slats in the raised position.
Figure 4:
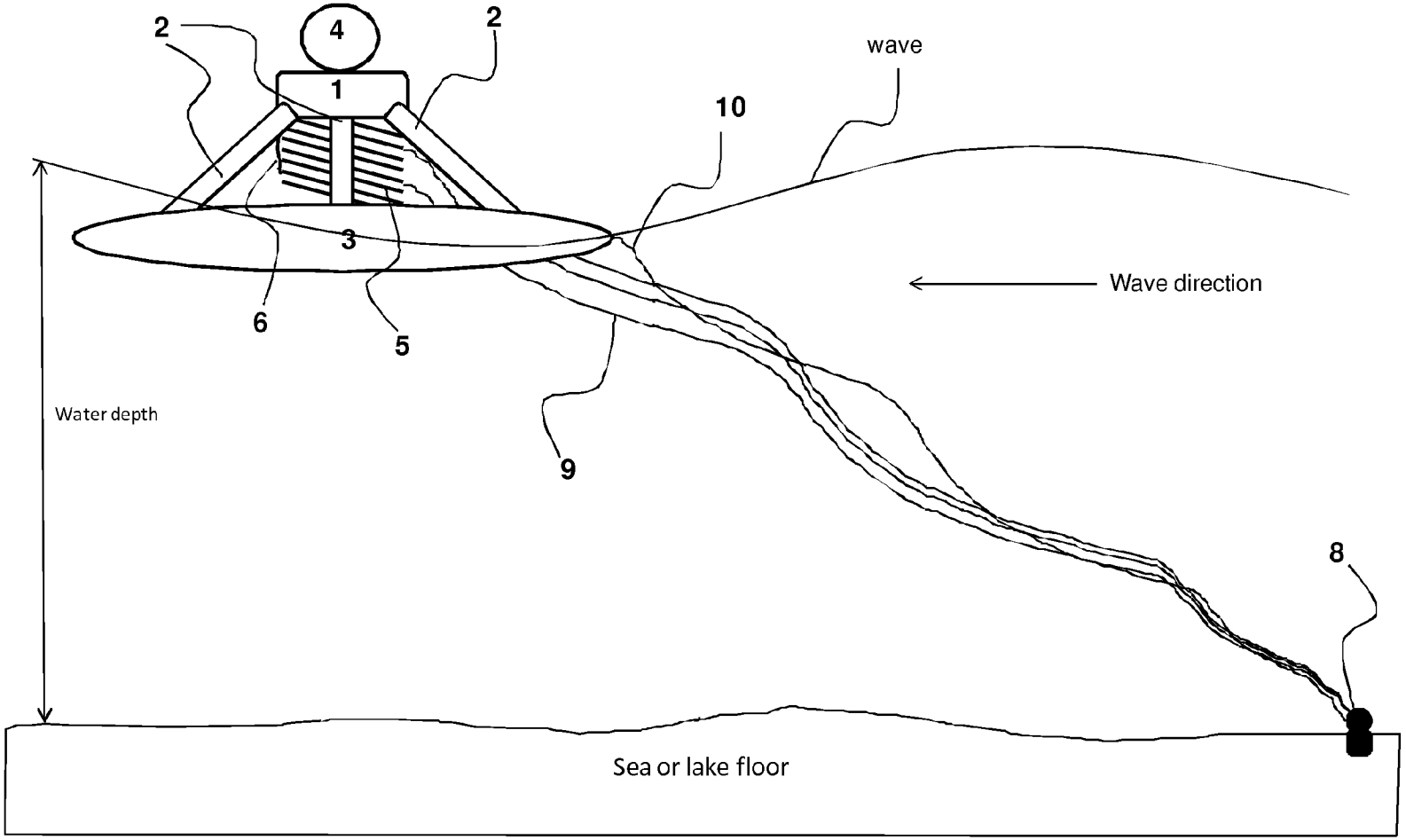
FIG. 4 is a general side view of the first embodiment of the modular breakwater of the present invention in the floating position over the wave trough, with the breakwater Venetian-like slats in the raised position.

FIGS. 3 and 4 show general side views of the first embodiment of the modular breakwater of the present invention in the floating position with the breakwater Venetian-like slats in the raised position. In FIG. 3, the breakwater device is floating over the wave crest and the anchor lines 9 and 10 are in a taut stage. In FIG. 4, the breakwater device is floating over the wave trough and the anchor lines 9 and 10 are in a slack stage. Notice the different shape of the main float 3 and stabilizing float 4. Main floats 3 are designed to make the breakwater float in a catamaran manner and they can be design in any shape that can accomplish that purpose. The stabilizing float 4 can also be designed in any shape as to accomplish the purpose of stabilizing the breakwater (i.e., keeping the main frame 1 in horizontal position when sinking it to or raising it from the seafloor). By filling main float 3 with seawater first, and then float 4, through a system that is described in connection with FIGS. 8 and 9, the breakwater may be sunk to the sea floor.

Figure 5:
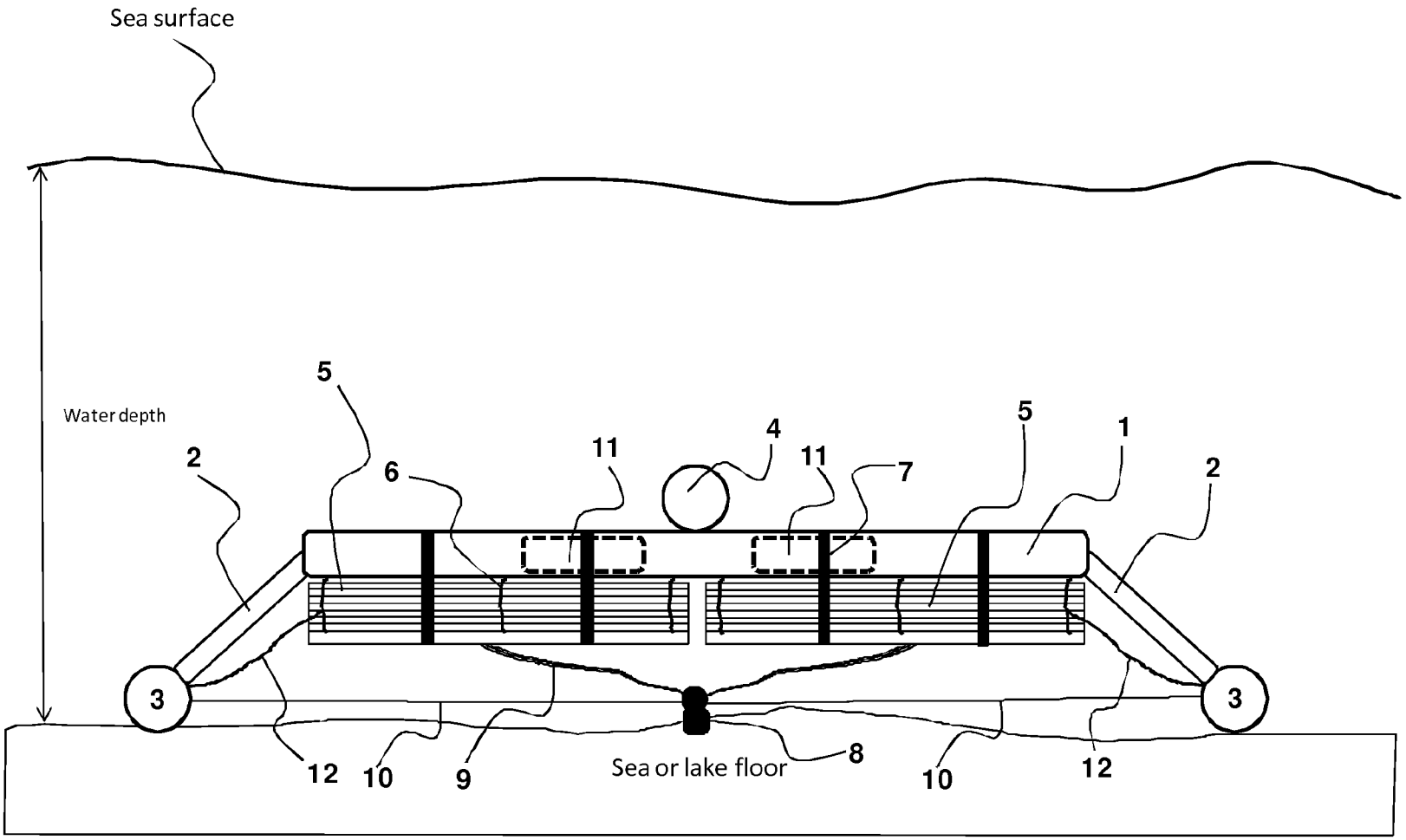
FIG. 5 is a general front view of the first embodiment of the modular breakwater of the present invention in the submerged position with the breakwater Venetian-like slats in the raised position.
Figure 6:
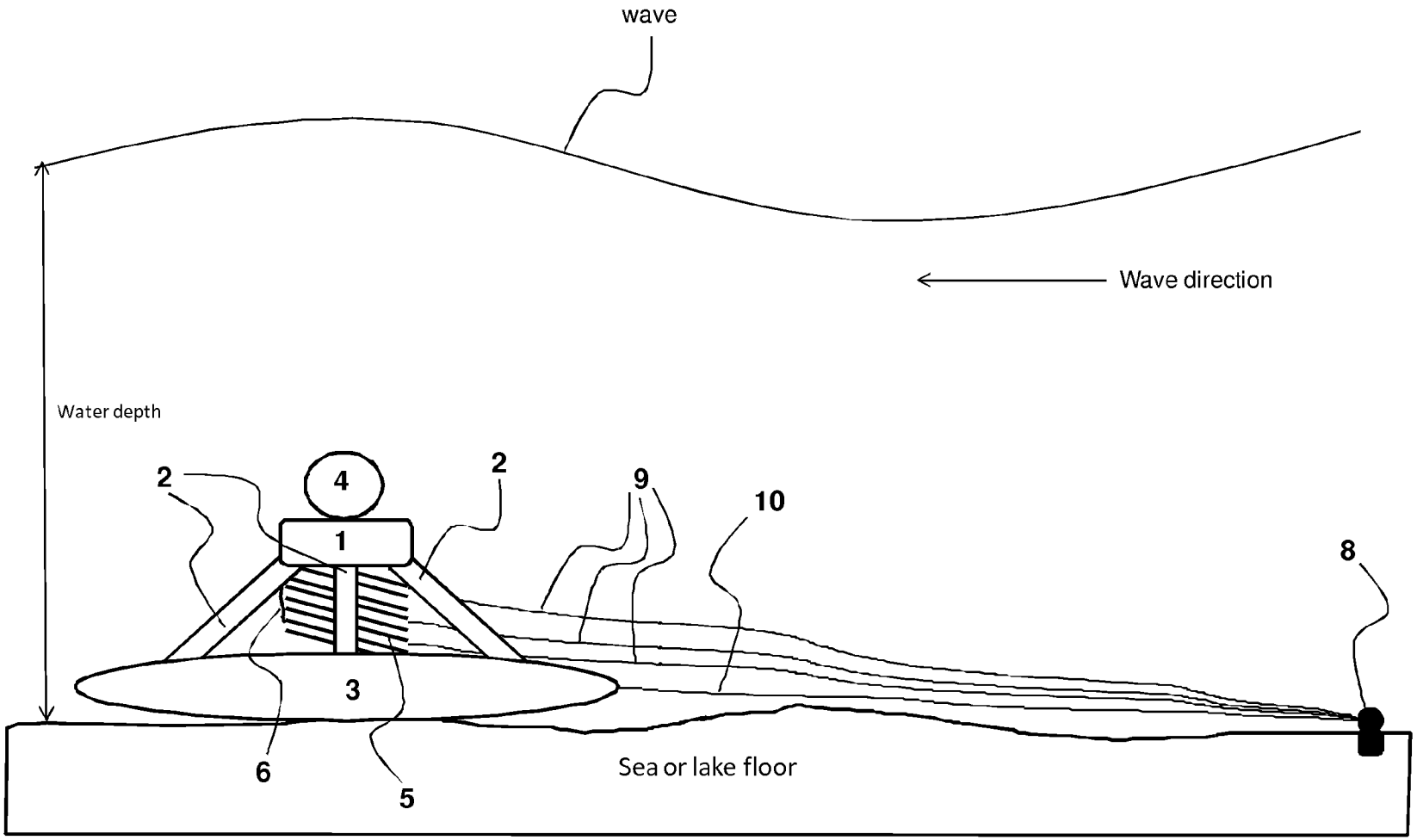
FIG. 6 is a general side view of the first embodiment of the modular breakwater of the present invention in the submerged position with the breakwater Venetian-like slats in the raised position.

FIGS. 5 and 6 show a general front and side view respectively of the first embodiment of the modular breakwater of the present invention in the submerged position with the breakwater Venetian-like slats in the raised position. It can be observed that main float 3 act as legs of the breakwater while resting on the sea floor.

Figure 7:
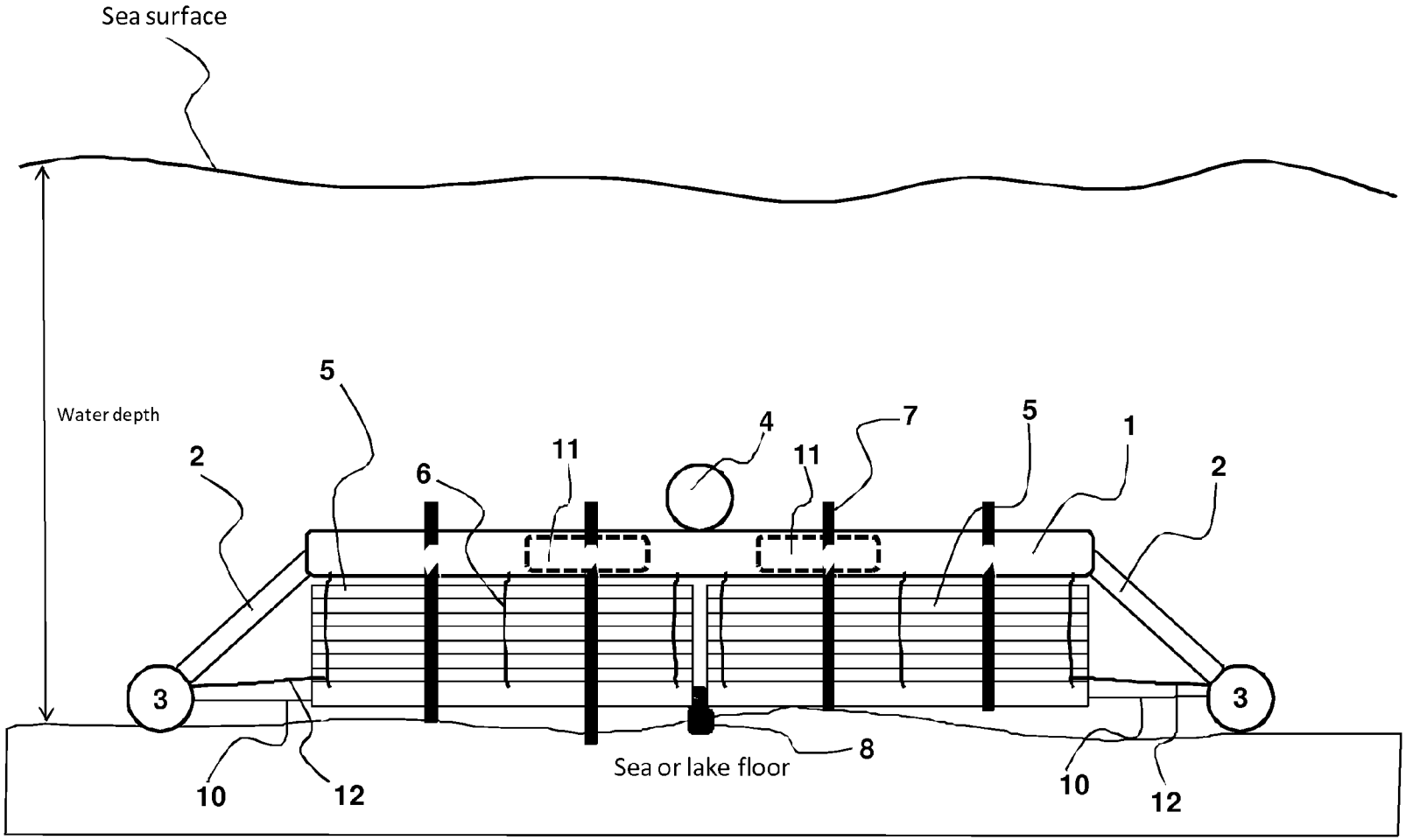
FIG. 7 is a general front view of the first embodiment of the modular breakwater of the present invention in the submerged position with the breakwater Venetian-like slats in the lowered position.

FIG. 7 is a general front view of the first embodiment of the modular breakwater of the present invention in the submerged position with the breakwater Venetian-like slats in a lowered position. Note that once the ropes, belts or equivalent elements 7 are cut or removed, the Venetian-like slats 5 fall into a lowered position, until they hit the sea floor. Also notice that the stabilizing lines 12 move down. The purpose of stabilizing lines 12 is to make sure that when the breakwater floats 3 are being filled with air through the air filling system explained in FIGS. 8 and 9, it keeps these floats 3 always below the mainframe 1 line, as the Venetian-like slats 5 add weight to these floats 3 when the slats are in the lowered position.

Figure 8:
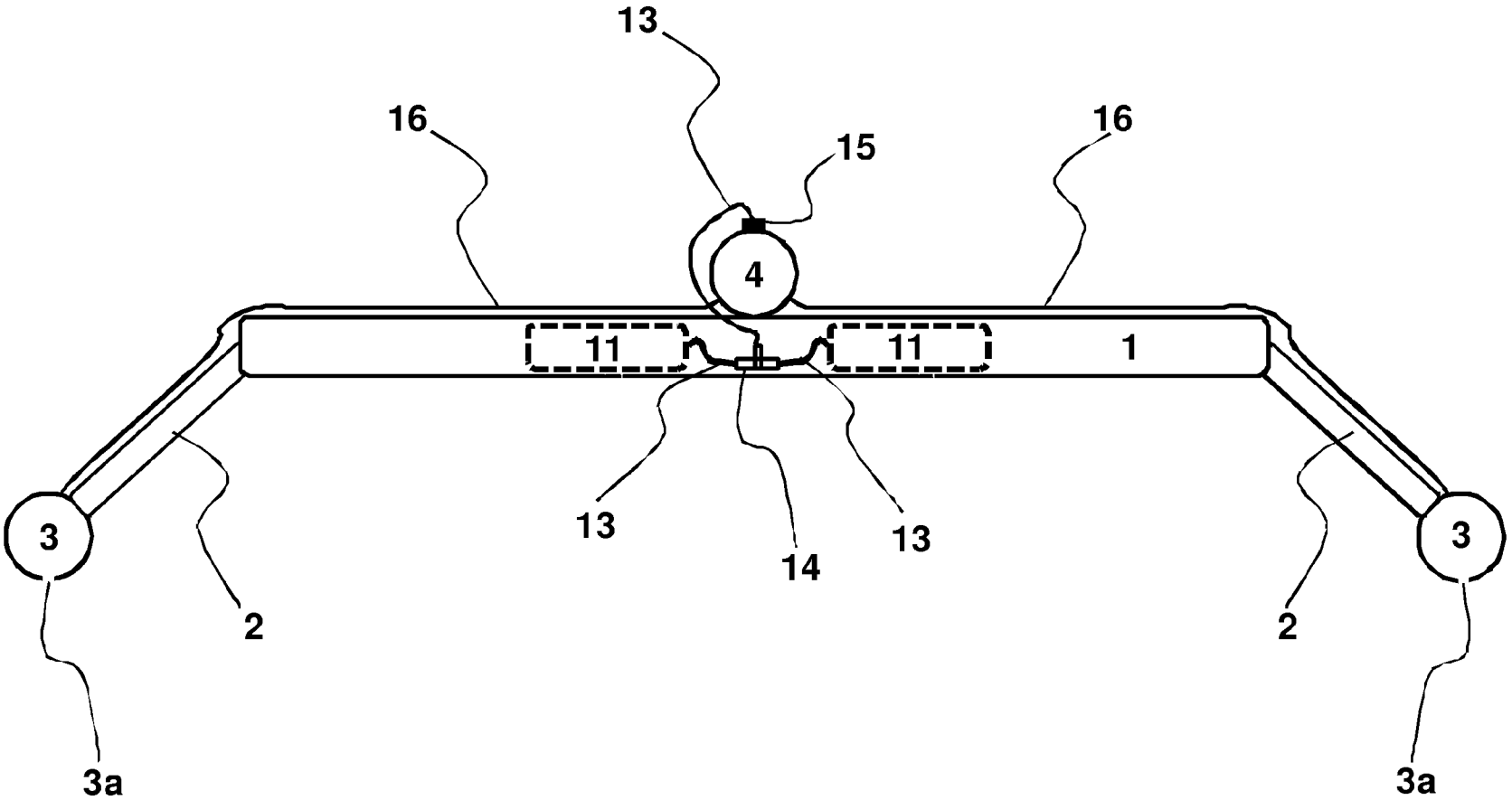
FIG. 8 is a schematic front view of the first embodiment of the modular breakwater of the present invention, illustrating the components of the system for filling the floating tanks with air.
Figure 9:
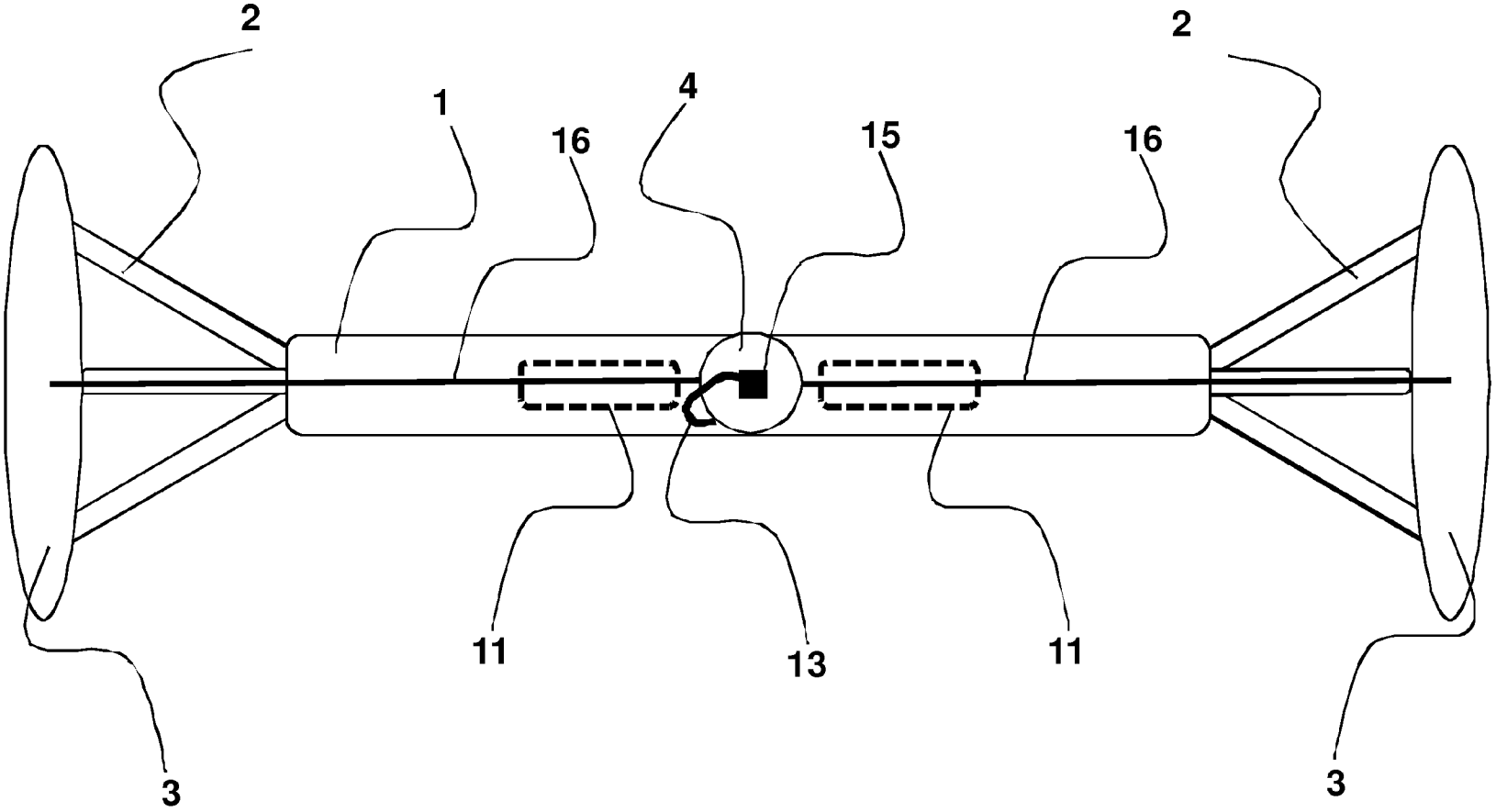
FIG. 9 is a schematic top view of the of first embodiment of the modular breakwater of the present invention, illustrating the components of the system for filling the floating tanks with air.

Once the ropes, belts or equivalent elements 7 are cut or removed, and the Venetian-like slats 5 fall into their lowered position, the stabilizing float 4 and the main floats 3 can be filled with air with the air filling system schematically shown in FIGS. 8 and 9. The air filling system shown in FIGS. 8 and 9 is composed of one or more pressurized tanks 11, connecting air lines or hoses 13 that connect the pressurized air tanks 11 with the air filling valve 15 positioned on top of the stabilizing tank 4 through connector element 14, and connecting air lines or hoses 16 that go from the bottom of the stabilizing float 4 to the main floats 3.

The procedure of filling the floats 4 and 3 is as follows. Valve 15 (which is a dual position valve, one position allows the entrance of air from the pressurized tanks 11 to the stabilizing float 4 and the other position allows air to out from the stabilizing float 4 to the environment) is put manually or automatically in the filling float 4 position, allowing air to come from pressurized tanks 11 to the top of float 4 through connecting air lines or hoses 13. As float 4 starts to be filled with air, the air displaces the seawater contained inside the float 4, lines or hoses 16, and main float 3, in that sequence. The seawater being displaced by the filling with air the system of floats and connecting lines or hoses is released to the environment through holes 3*a* that are positioned in the lowest point in the middle of main floats 3.

Since stabilizing float 4 is in the center of the breakwater module and also is the highest of the floats, it keeps the main frame 1 in a horizontal position when the breakwater is being filled with air and therefore raised from the seafloor to the water surface. In the opposite manner, when the breakwater is afloat, the procedure to sink the breakwater to the sea floor is to place valve 15 in the position that allows air out of float 4 to the environment. This allows seawater to enter floats 3 through holes 3*a* displacing air upwardly first through floats 3, then through lines or hoses 16 and then through float 4 until the breakwater sinks to the sea floor.

Figure 10:
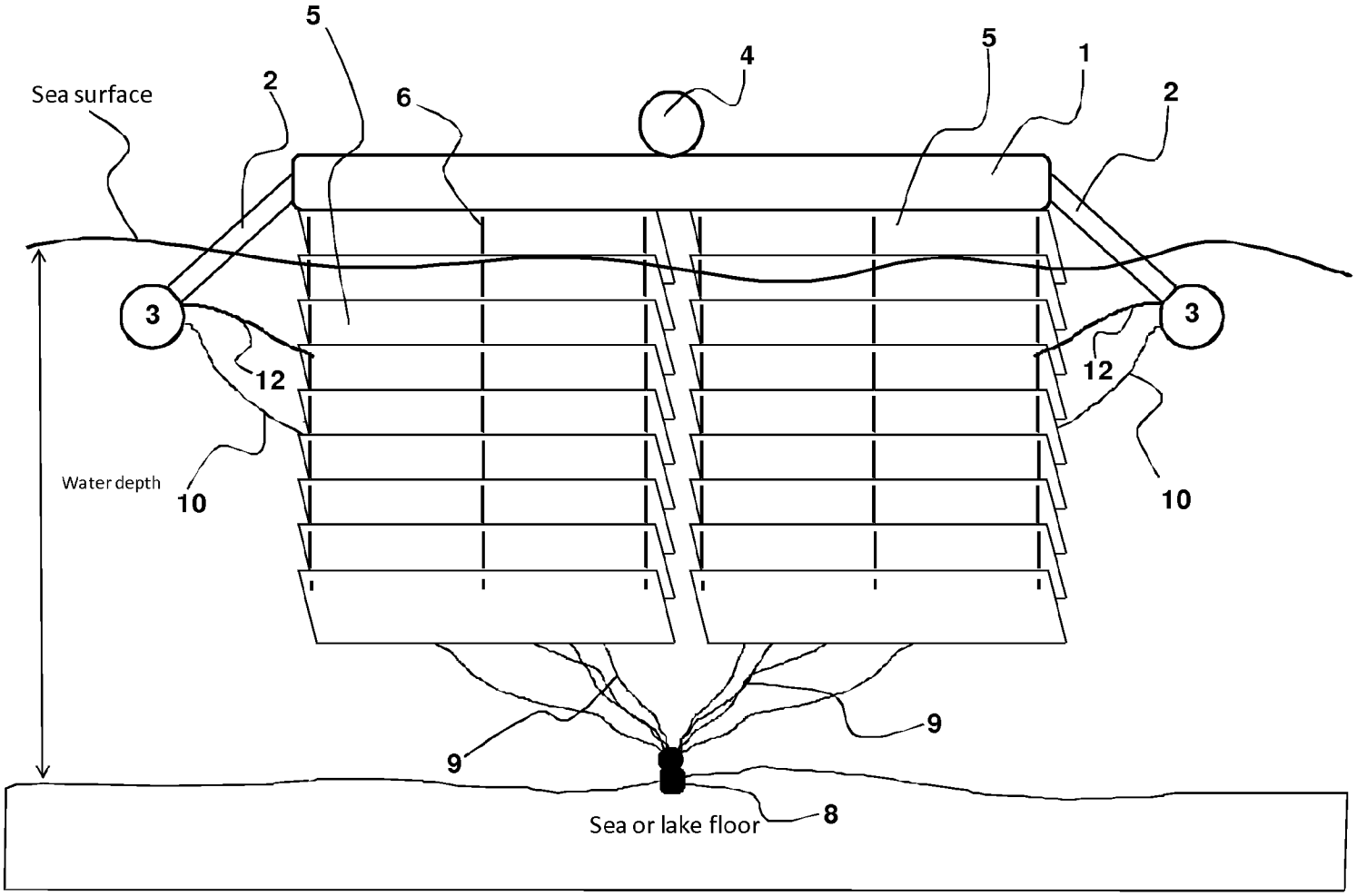
FIG. 10 is a general front view of the first embodiment of the modular breakwater of the present invention in the floating position with the breakwater Venetian-like slats in the lowered position.

FIG. 10 is a general front view of the first embodiment of the modular breakwater of the present invention in the floating position with the breakwater Venetian-like slats 5 in the lowered position. Note that the main frame 1 is out of the water due to the floating force of main floats 3. Also note that the stabilizing lines 12 are pushed down by the weight of the lose Venetian-like slats 5, maintaining the entire breakwater stable by keeping the main floats 3 under the main frame 1 horizontal line. The lines 6 that hold the Venetian-like slats 5 in position are all taut due to the weight of the slats.

Figure 11:
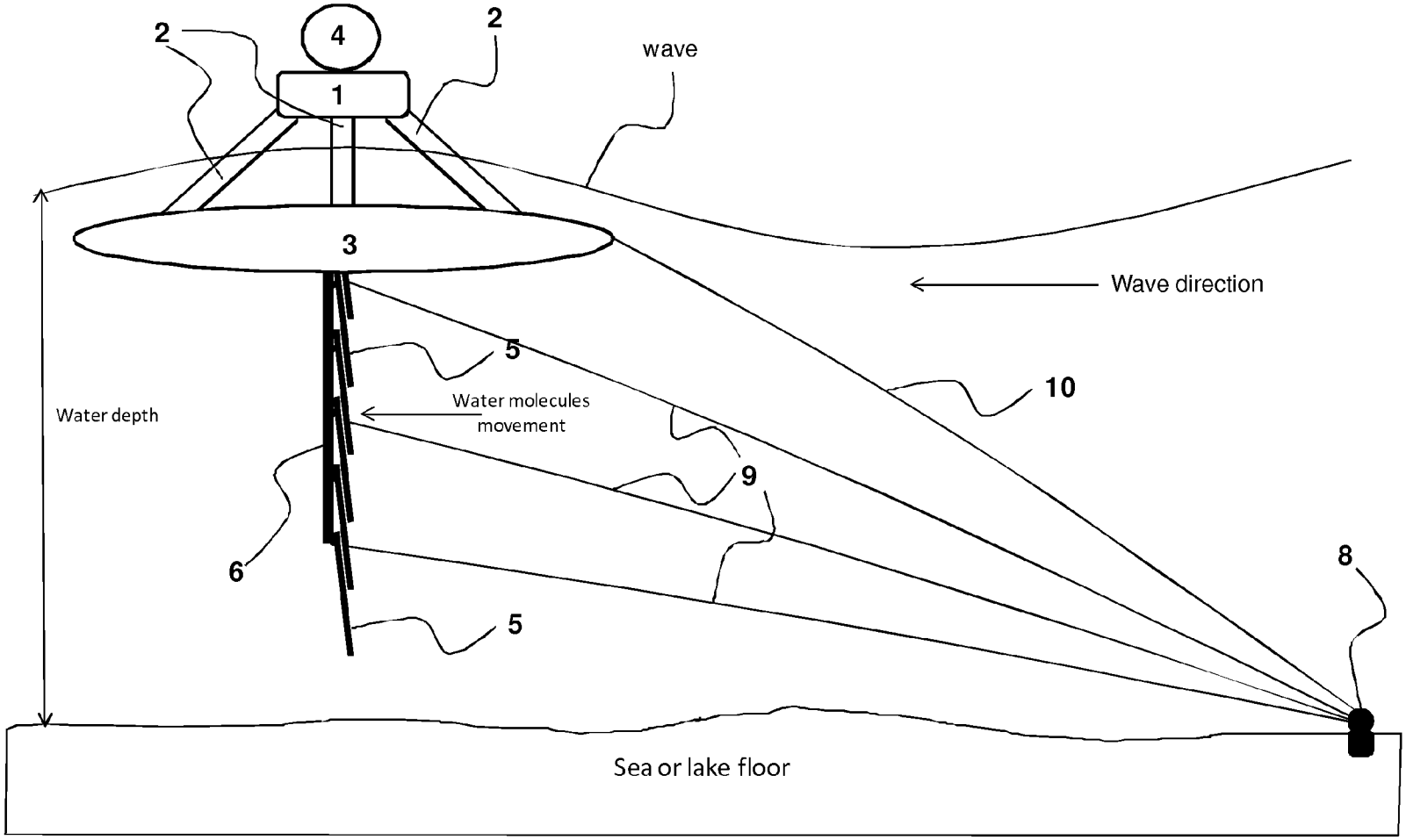
FIG. 11 is a general side view of the first embodiment of the modular breakwater of the present invention in the floating position with the lose breakwater Venetian-like slats in the closed position.
Figure 12:
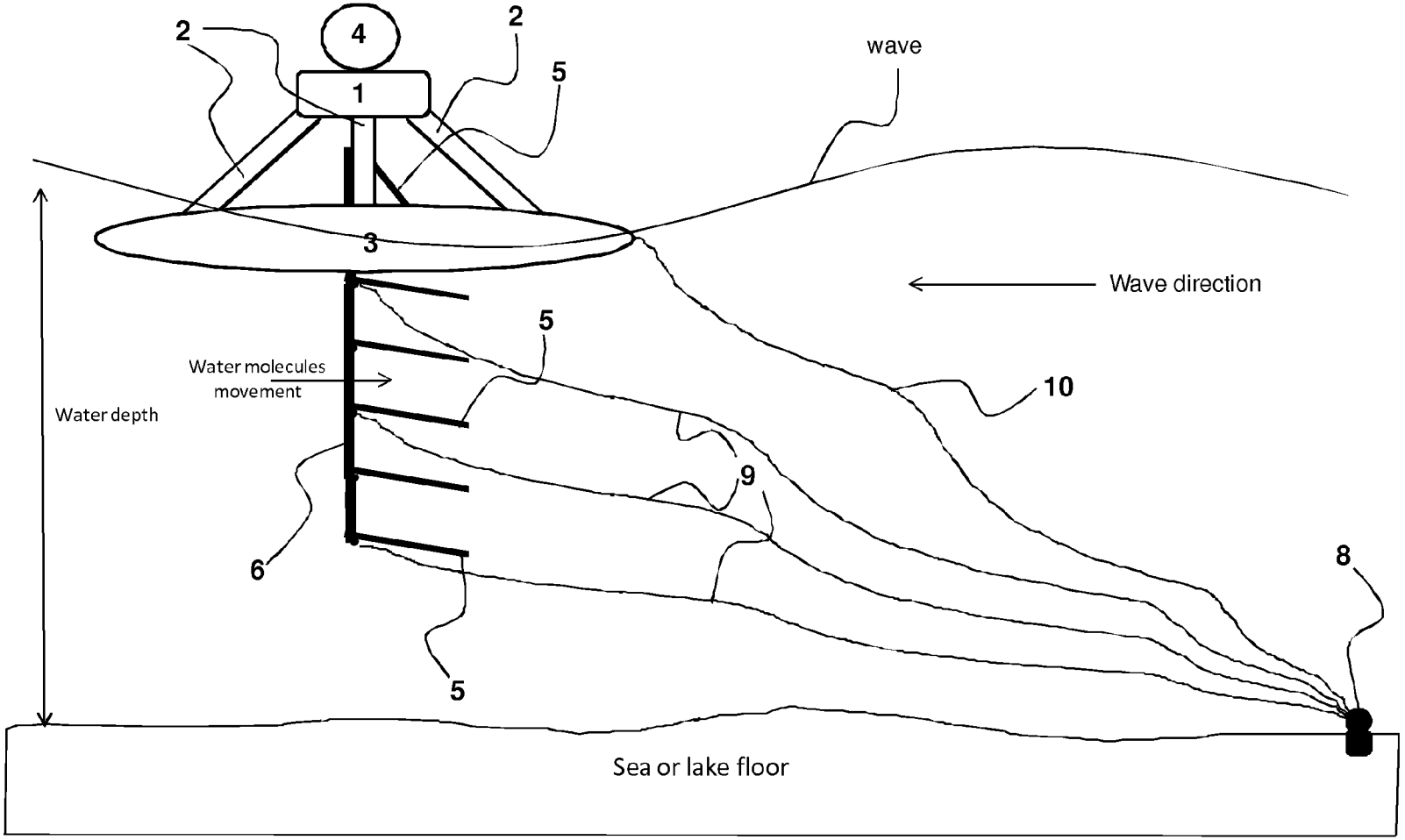
FIG. 12 is a general side view of the first embodiment of the modular breakwater of the present invention in the floating position with the lose breakwater Venetian-like slats in the open position.

FIG. 11 is a general side view of the first embodiment of the modular breakwater of the present invention floating on the wave crest with the Venetian-like slats 5 in the lowered position. The Venetian-like slats 5 may pivot as shown in FIGS. 11 and 12, much as Venetian blinds do. The Venetian-like slats 5 may pivot on a hinge or be tied together by line 6, much as in a Venetian blind mechanism. Thus, the Venetian-like slats 5 may be raised and lowered and may also pivot. Note that, because in the wave crest the movement of water molecules is in the same direction of the wave, and the Venetian-like slats 5 are pushed together (closed) thus preventing the passing of water and making the anchor lines 9 and 10 to be in a taut manner. Since the anchor lines in the taut mode do not allow the breakwater to move in the wave direction, the breakwater acts as a wall, stopping the movement of water molecules and therefore lowering the kinetic energy of the wave in the wave direction.

FIG. 12 is a general side view of the first embodiment of the modular breakwater of the present invention floating on the wave trough with the Venetian-like slats 5 in the lowered position. Note that, because in the wave trough the movement of water molecules is in the opposite direction of the wave, and the Venetian-like slats 5 are pushed to an open position allowing therefore the passing of water and making the anchor lines 9 and 10 to be in a slack manner. Since the breakwater on the trough of the wave offers little resistance to the water molecule movement in the opposite direction to the wave direction, due to its floating as a catamaran and the opening of the Venetian-like slats allowing the passing of water, the breakwater tends to stay in position. So, when the next wave crest passes the breakwater, the Venetian-like slats 5 will close and the anchor lines 9 and 10 quickly become taut, not allowing the movement of water in the wave direction and therefore lowering the kinetic energy of the wave in that direction.

Figure 13:
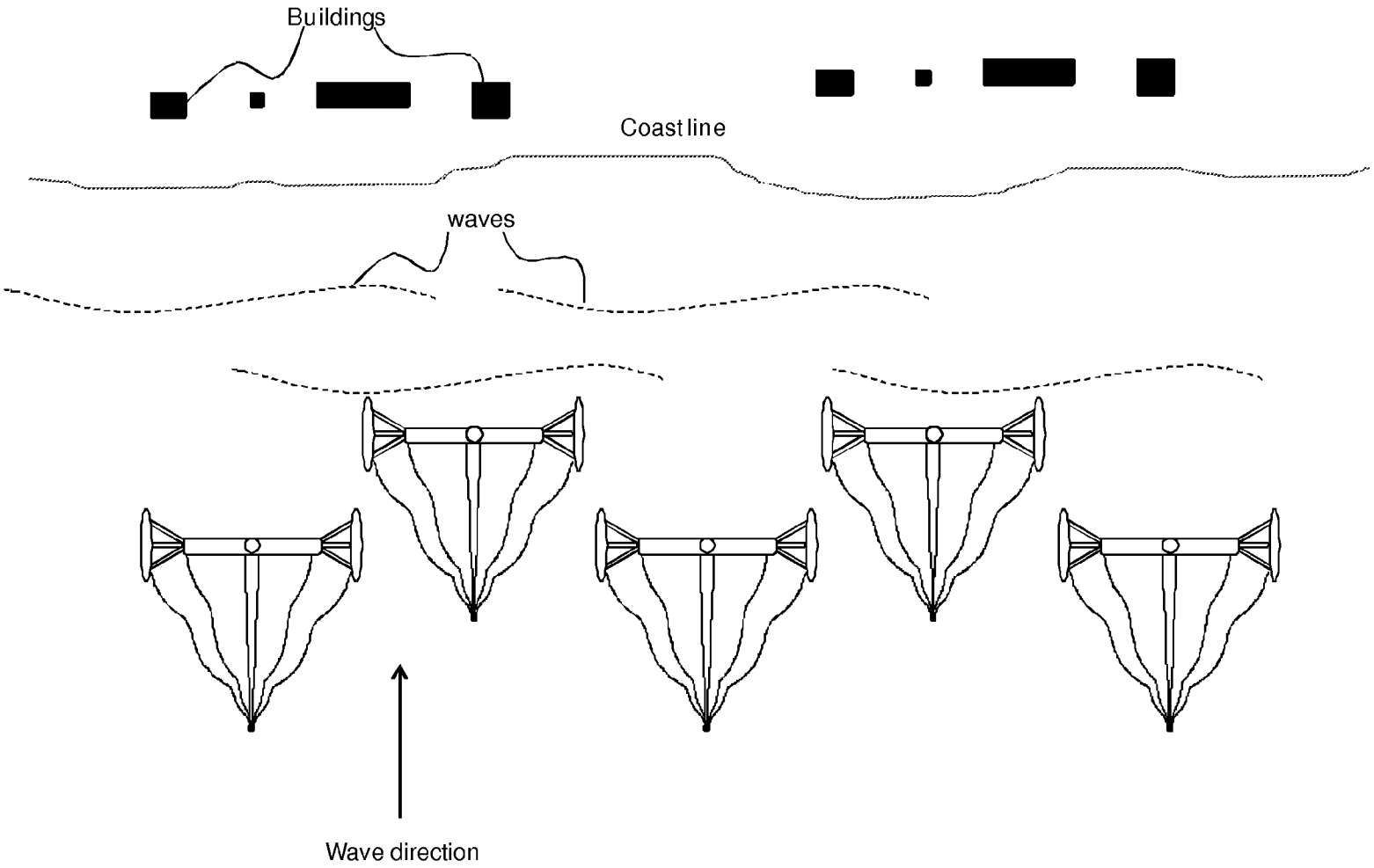
FIG. 13 is a schematic top view of an embodiment of several modular breakwaters of the present invention along a coastline where the wave direction is perpendicular to the coastline.
Figure 14:
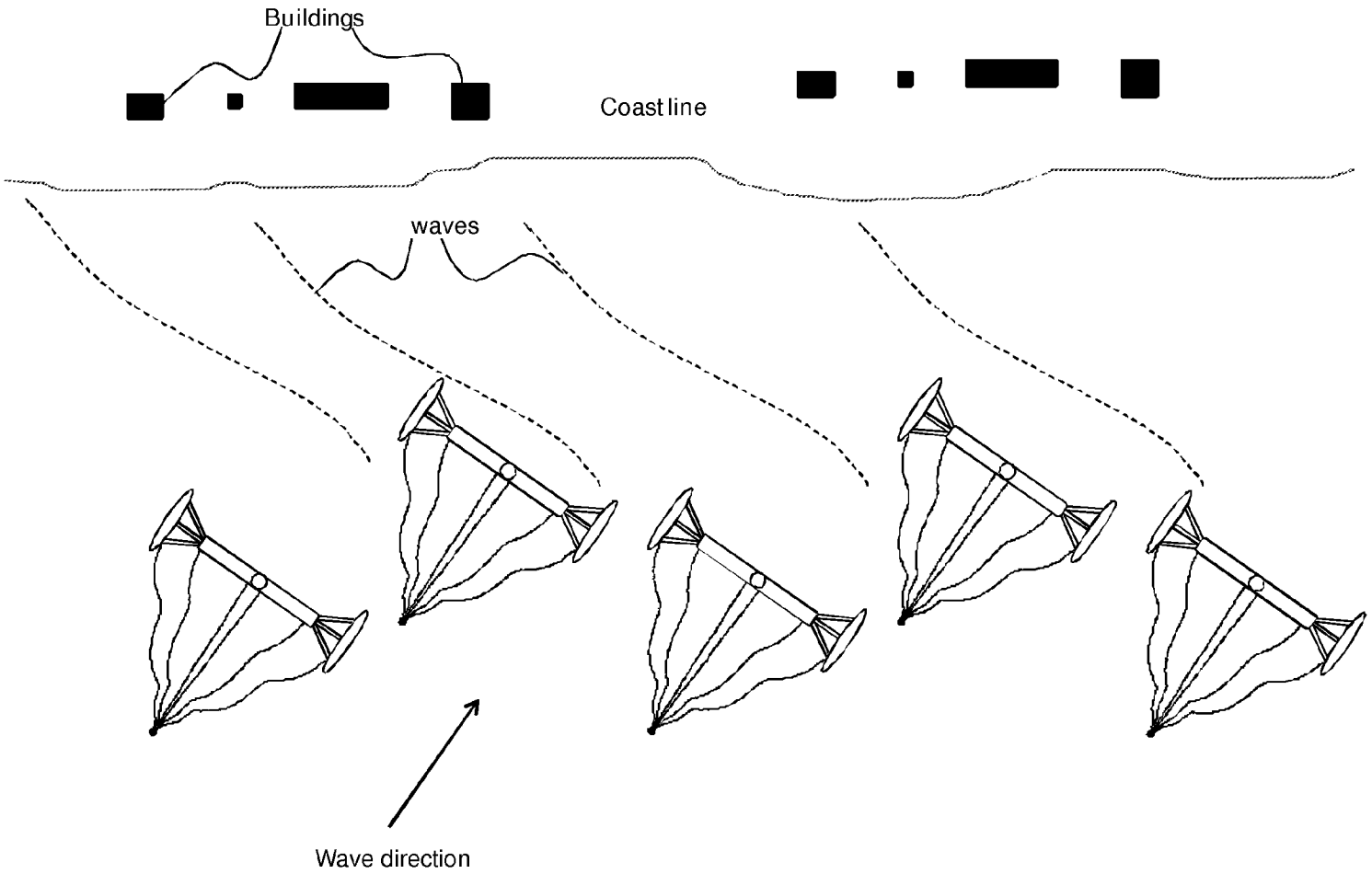
FIG. 14 is a schematic top view of an embodiment of several modular breakwaters of the present invention along a coastline where the wave direction is in an angle from left to right to the coastline.
Figure 15:
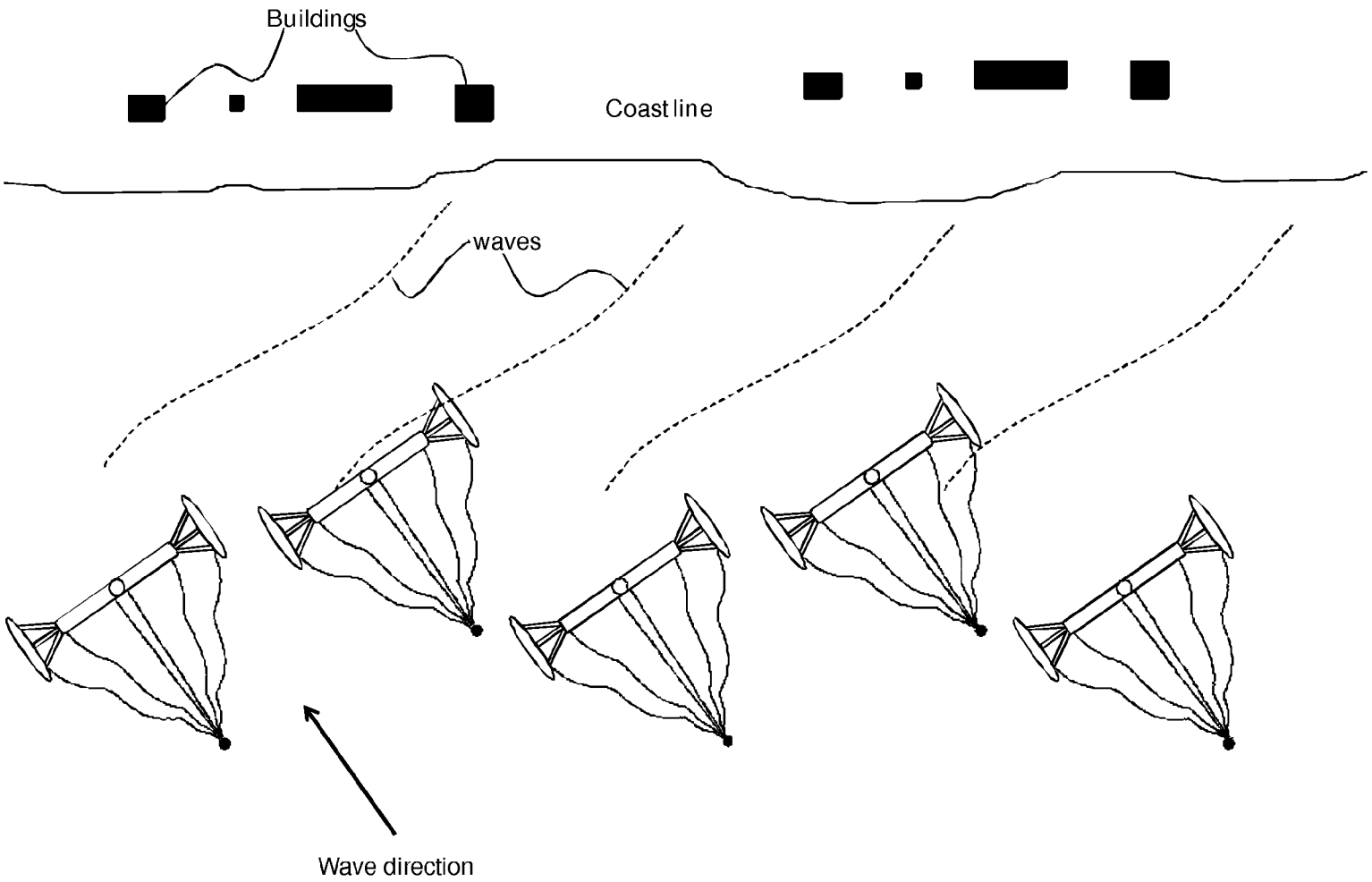
FIG. 15 is a schematic top view of an embodiment of several modular breakwaters of the present invention along a coastline where the wave direction is in an angle from right to left to the coastline.

FIG. 13 is a schematic top view of an embodiment of several modular breakwaters of the present invention along a coastline where the wave direction is perpendicular to the coastline. As the incoming wave approaches the device, water molecules moving in the direction of the wave push closed the Venetian-like slats, allowing therefore the breakwater to stop the movement of water in that direction, thus lowering the kinetic energy of the wave that will reach the coastline. FIGS. 14 and 15 are schematic top views of an embodiment of several modular breakwaters of the present invention along a coastline where the wave direction is in an angle from left to right and right to left to the coastline respectively.

Figure 16:
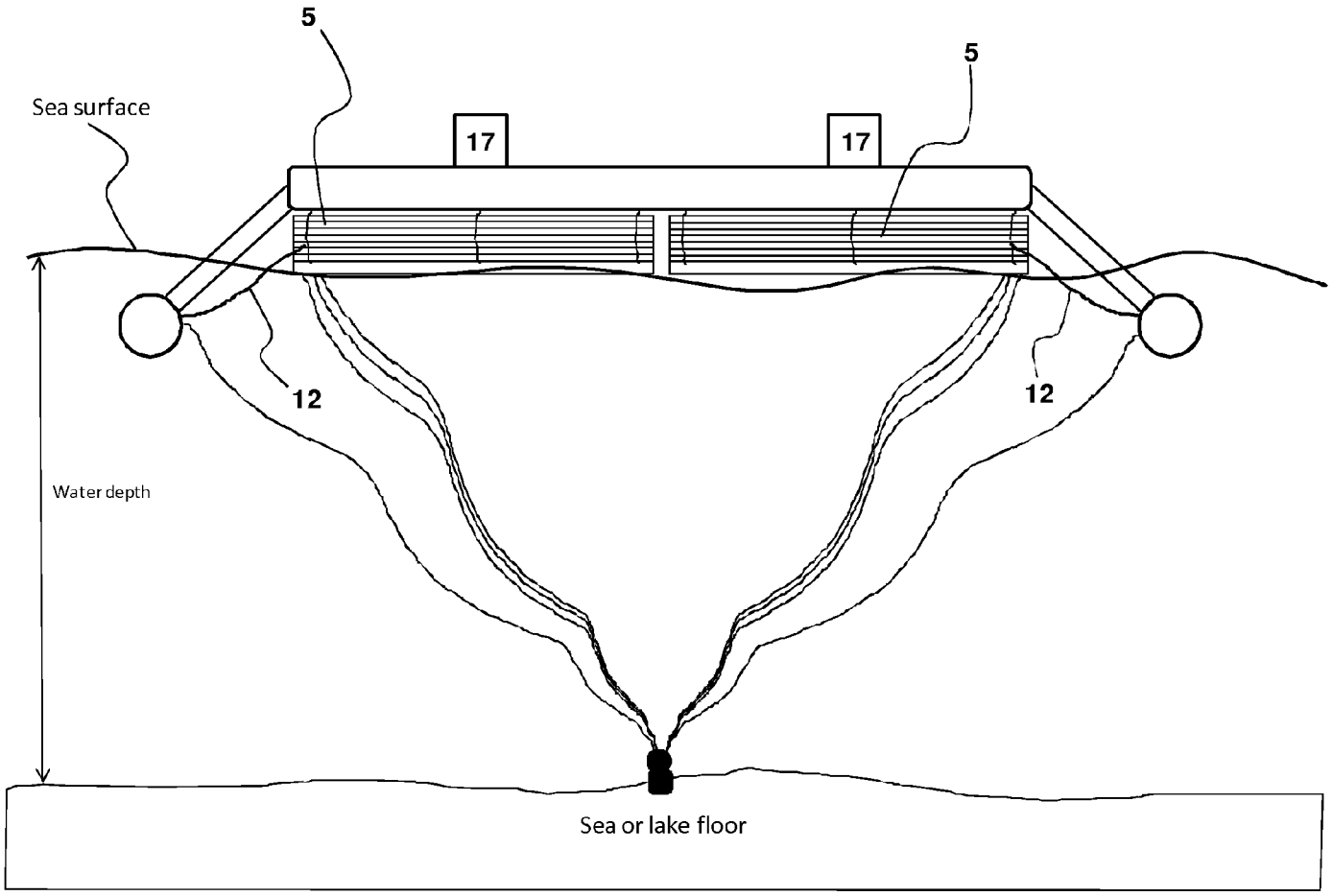
FIG. 16 is a general front view of a second embodiment of the modular breakwater of the present invention, which is always in a floating position, with the breakwater Venetian-like slats in the raised position where the raising or lowering of the slats is performed by a mechanism.

FIG. 16 is a general front view of a second embodiment of the modular breakwater of the present invention in the floating position with the breakwater Venetian-like slats 5 in the raised position where the raising or lowering of the slats is performed by a mechanism 17. In this embodiment, the breakwater device will always be afloat, so there is no need for an air filling system described in FIGS. 8 and 9, nor the need for a stabilizing float 4. Main floats 3 may not need the holes 3*a* in the lowest position.

Figure 17:
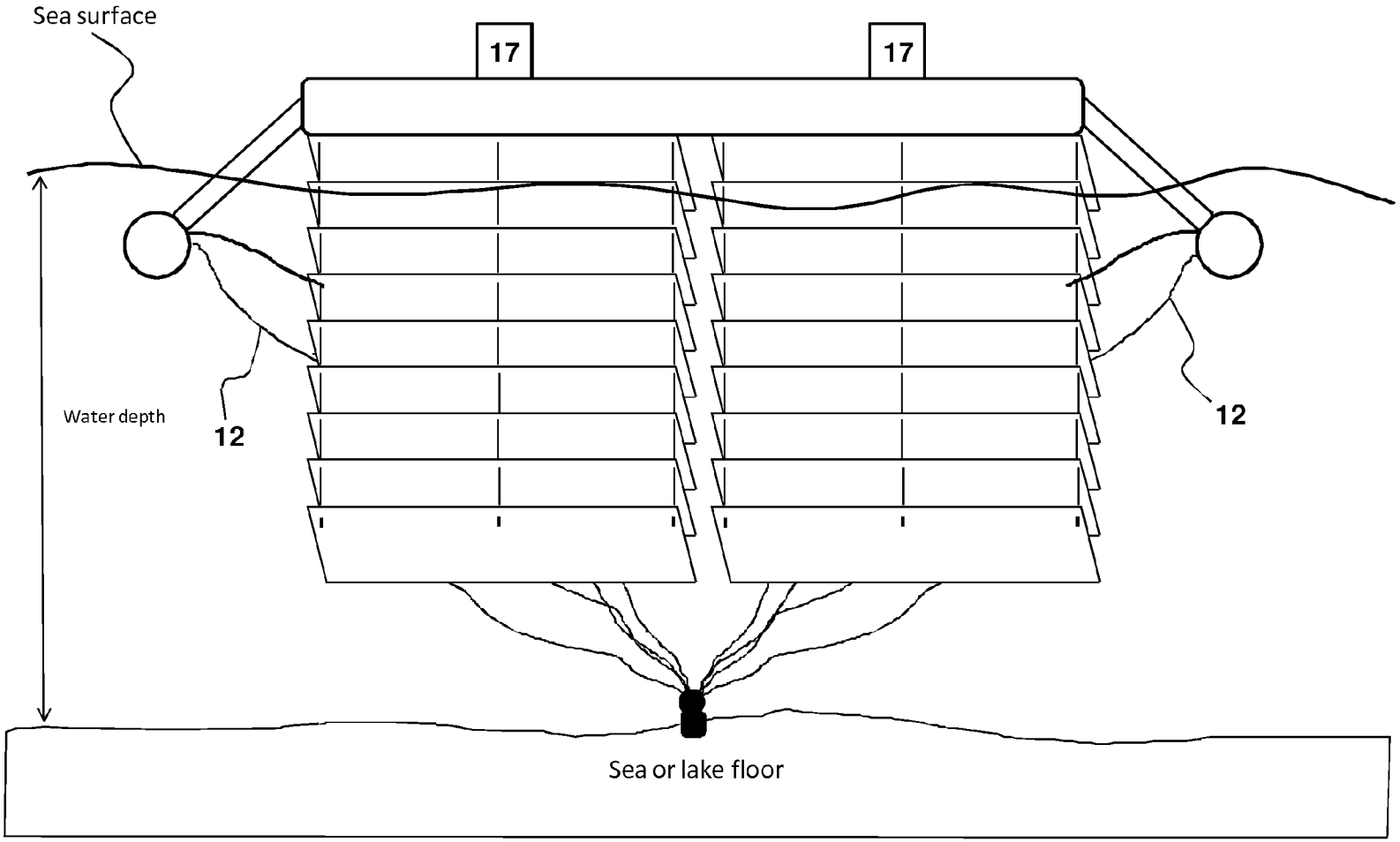
FIG. 17 is a general front view of the second embodiment of the modular breakwater of the present invention, which is always in a floating position, with the breakwater Venetian-like slats in the lowered position.

FIG. 17 is a general front view of the second embodiment of the modular breakwater of the present invention in the floating position with the breakwater Venetian-like slats 5 in the lowered position where the raising or lowering of the slats is performed by a mechanism 17.

Figure 18:
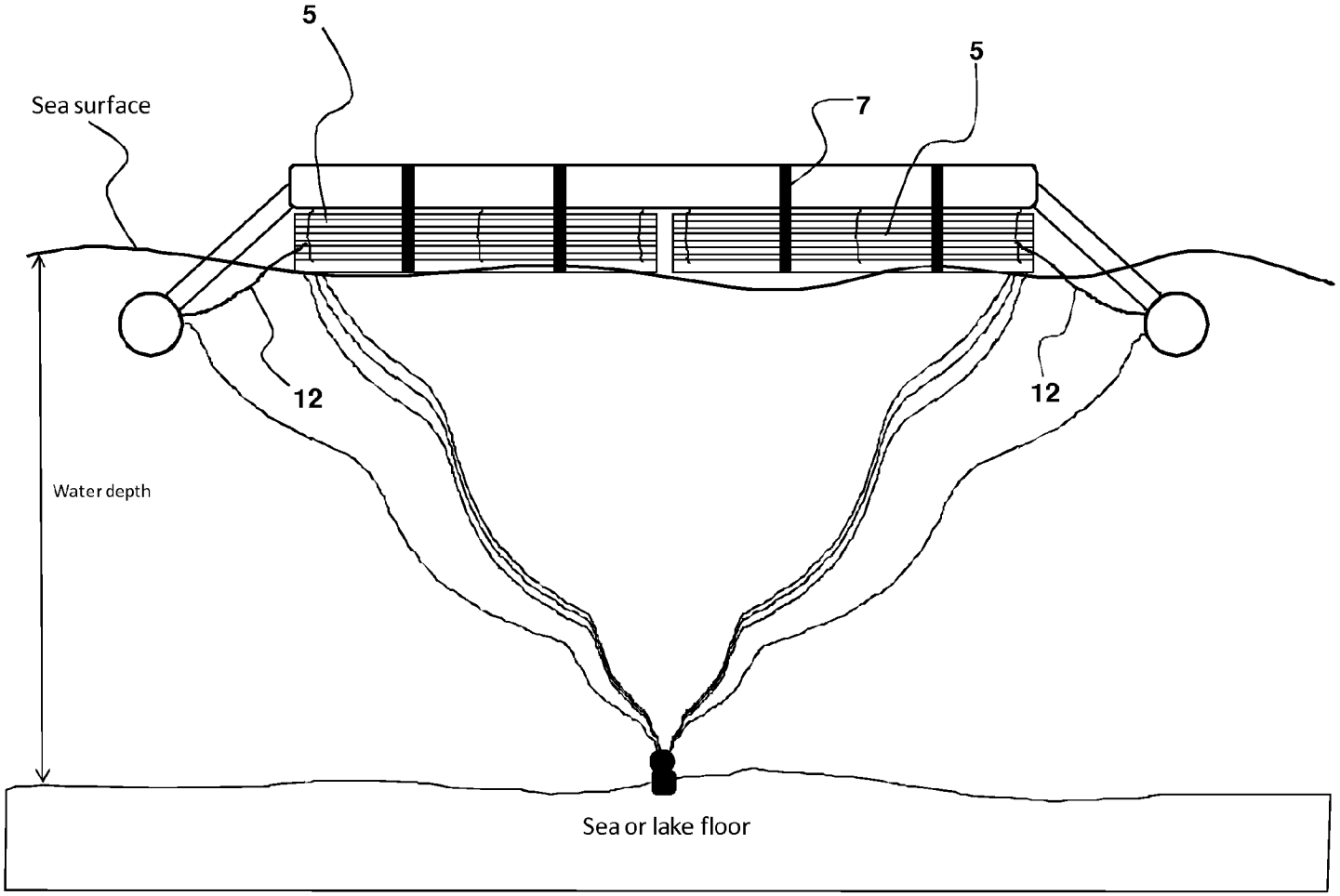
FIG. 18 is a general front view of a third embodiment of the modular breakwater of the present invention, which is always in a floating position, with the breakwater Venetian-like slats in the raised position with no mechanism for raising or lowering of the slats.

FIG. 18 is a general front view of a third embodiment of the modular breakwater of the present invention in the floating position with the breakwater Venetian-like slats 5 in the raised position, without any slats raising or lowering mechanism 17. In this embodiment, the breakwater device will always be afloat, so there is no need for an air filling system described in FIGS. 8 and 9, nor the need for a stabilizing float 4. Main floats 3 may not need the holes 3*a* in the lowest position. The Venetian-like slats 5 are shown in their raised position with ropes, belts or equivalent elements 7.

Figure 19:
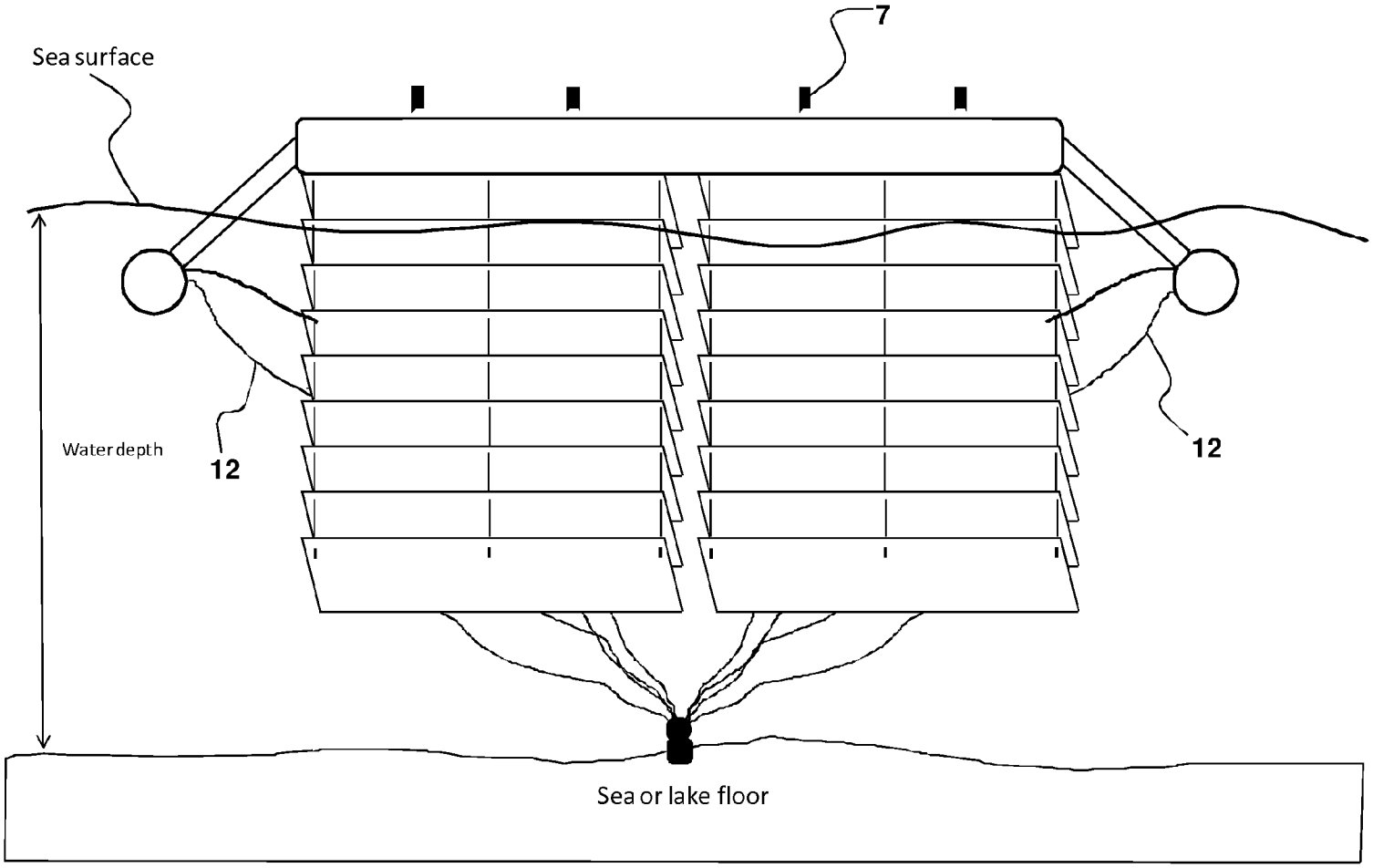
FIG. 19 is a general front view of the third embodiment of the modular breakwater of the present invention, which is always in a floating position, with the breakwater Venetian-like slats in the lowered position with no mechanism for raising or lowering of the slats.

FIG. 19 is a general front view of the third embodiment of the modular breakwater of the present invention in the floating position with the breakwater Venetian-like slats 5 in the lowered position. Notice that, once the ropes, belts or equivalent elements 7 are cut or removed, the Venetian-like slats 5 fall into their lowered position due to the force of gravity.

Figure 20:
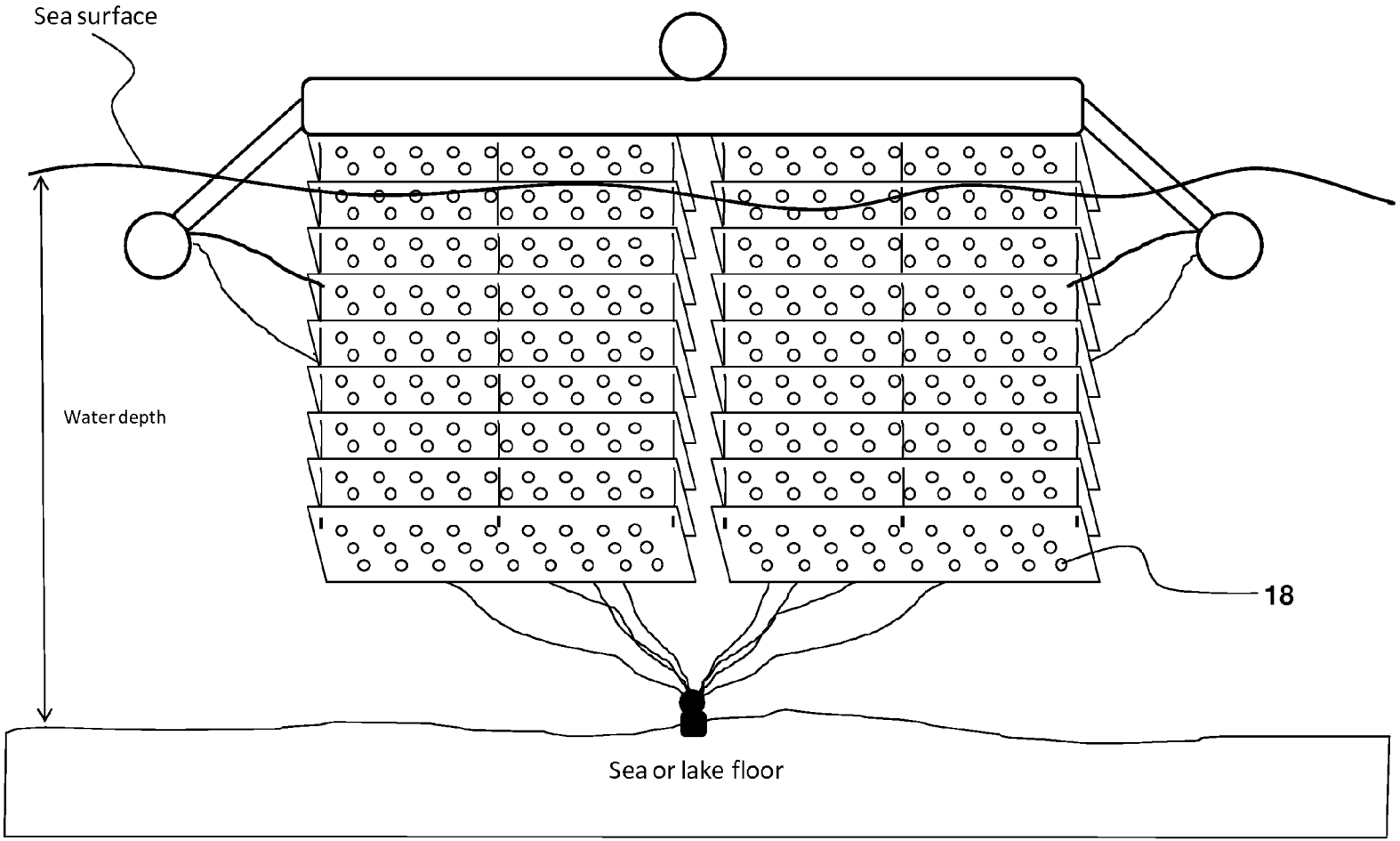
FIG. 20 is a general front view of a fourth embodiment of the modular breakwater of the present invention in the floating position with the breakwater Venetian-like slats with holes to allow water to pass through when the breakwater is in the wave crest and the slats are closed.

FIG. 20 is a general front view of a fourth embodiment of the modular breakwater of the present invention in the floating position where the breakwater Venetian-like slats 5 have holes 18 that may allow water to pass through when the breakwater is in the wave crest and the slats are closed. Water passing through the holes 18 will experience turbulence therefore lowering the kinetic energy of the wave in the direction of the wave. These Venetian-like slats with holes 18 can be used in all previous embodiments.

Figure 21:
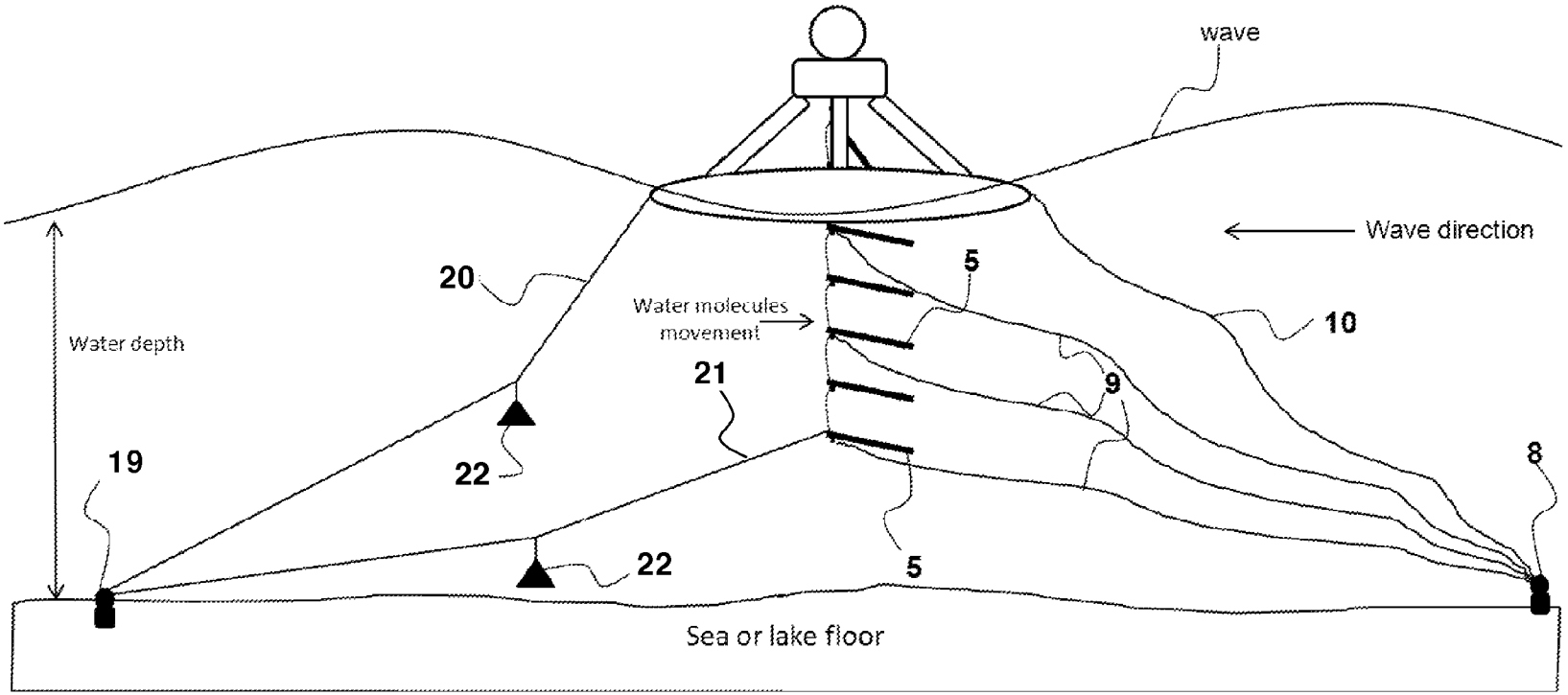
FIG. 21 is a general side view of a fifth configuration of the modular breakwater of the present invention in the floating position on the trough of the wave with the lose breakwater Venetian-like slats in the open position, ideal when the incident wave angle with respect to the coast is always the same.

FIG. 21 is a general side view of the fifth configuration of the modular breakwater of the present invention floating on the wave trough with the Venetian-like slats 5 in the lowered position. Note that, because in the wave trough the water molecules movement is in the opposite direction of the wave, the Venetian-like slats 5 are pushed to an open position allowing therefore the passing of water and making the anchor lines 9 and 10 to be in a slack manner. Since the breakwater on the trough of the wave offers little resistance to the water molecule movement in the opposite direction to the wave direction, due to its floating as a catamaran and the opening of the Venetian-like slats allowing the passing of water, the breakwater tends to stay in position. When the incident wave angle with respect to the coast is always the same, in order to reduce even more the movement of the breakwater away from the coast when it is in the trough of the wave and the water molecules are moving in the opposite direction of the wave, anchor 19 can be placed between the breakwater and the coast so anchor lines 20 and 21 can be attached to the floats 3 and the lines holding the slats 5. Lines 20 and 21 can have weights 22 added so they are always in a taut manner. These anchor lines (20 and 21) will hold the breakwater in position when it is in the wave trough.

While the preferred embodiment and various alternative embodiments of the invention have been disclosed and described in detail herein, it may be apparent to those skilled in the art that various changes in form and detail may be made therein without departing from the spirit and scope thereof.

We claim:

1. A floating modular breakwater comprising:

at least one main float;

a plurality of anchor lines, anchoring the at least one anchored float to a floor of a body of water;

a plurality of pivoting parallel slats, coupled to the at least one main float, configured to pivot to a closed position when water current passes in one direction and thus resist movement of the water current, and to pivot to an open position when the water current passes in another direction, and thus prove little resistance to the movement of the water current; and at least one pair of lines extending downwardly from the at least one main float, the at least one pair of lines supporting the plurality of pivoting parallel slats and configured to raise and lower the plurality of pivoting parallel slats, such that when the at least one pair of lines is retracted to the at least one main float, the plurality of parallel slats retracts underneath the at least one main float.

2. The floating modular breakwater of claim 1, further including:

at least one air line configured to selectively provide air to the at least one main float so as to displace water from the at least one main float;

at least one valve, attached to the at least one main float, configured to selectively allow air to be discharged from the main float; and at least one water inlet in the at least one main float, configured to allow water to enter the float when air is discharged, such that the at least one main float may be selectively sank or raised on command.

3. The floating modular breakwater of claim 1, wherein the at least one main float comprises at least two main floats, the floating modular breakwater further including:

a longitudinal main frame, coupled to the at least two main floats, supporting the plurality of pivoting parallel slats the main frame, each of the at least two main floats located on a corresponding end of the longitudinal main frame; and a plurality of stabilizer lines, each connecting a corresponding one of the at least two main floats to one or more of the at plurality of parallel slats and configured to insure that when the at least two main floats are being filled with air, they keep these floats below the longitudinal main frame.

4. The floating modular breakwater of claim 1, wherein the at least one main float comprises at least two main floats, the floating modular breakwater further including:

a longitudinal main frame, coupled to the at least two main floats, supporting the plurality of pivoting parallel slats the main frame, each of the at least two main floats located on a corresponding end of the longitudinal main frame.

5. The floating modular breakwater of claim 2, wherein the at least one main float comprises at least two main floats, the floating modular breakwater further including:

a longitudinal main frame, coupled to the at least two main floats, supporting the plurality of pivoting parallel slats the main frame, each of the at least two main floats located on a corresponding end of the longitudinal main frame.

6. The floating breakwater of claim 5, further including:

at least one stabilizer float, coupled to a center portion of the longitudinal main frame configured to hold the longitudinal main frame in a horizontal position when the breakwater is being sunk from a floating position or raised from a submerged position.

7. The floating breakwater of claim 6, further including an air system for filling and emptying the stabilizing float and the at least two main floats, the air system comprising:

one or more pressurized air tanks;

the at least one valve includes a dual position valve, where one position allows the entrance of air from the pressurized tanks to the stabilizing float and the other position allows air to out from the stabilizing float to the environment, the at least one valve located at a highest point of the stabilizing float;

air flow connection lines extending from the pressurized tanks to the dual position valve at the top of the stabilizing float; and air-water flow connection lines extending from a lower position of the stabilizing float to top positions of the at least two main floats.

8. The floating breakwater of claim 4, further including:

a release mechanism, securing the plurality of pivoting parallel slats in a retracted position beneath the main frame, and configured to release the plurality of pivoting parallel slats, such that when the release mechanism is activated, the plurality of parallel slats extend downward from the main frame under influence of gravity.

9. The floating breakwater of claim 1, wherein the plurality of parallel slats further includes:

a plurality of holes in slats allowing water to pass through when the breakwater is on a wave crest and the plurality of parallel slats are closed, configured such that water passing through the plurality of holes will experience turbulence therefore lowering the kinetic energy of the wave in the direction of the wave.

10. A floating modular breakwater comprising a plurality of floating modular breakwaters, anchored offshore, each of the plurality of floating modular breakwaters comprising:

at least one main float;

a plurality of anchor lines, anchoring the at least one anchored float to a floor of a body of water;

a plurality of pivoting parallel slats, coupled to the at least one main float, configured to pivot to a closed position when water current passes in one direction and thus resist movement of the water current, and to pivot to an open position when the water current passes in another direction, and thus prove little resistance to the movement of the water current; and at least one pair of lines extending downwardly from the at least one main float, the at least one pair of lines supporting the plurality of pivoting parallel slats and configured to raise and lower the plurality of pivoting parallel slats, such that when the at least one pair of lines is retracted to the at least one main float, the plurality of parallel slats retracts underneath the at least one main float, wherein the plurality of floating modular breakwaters are anchored offshore such that a longitudinal axis of each of the plurality of floating modular breakwaters is parallel to wave direction.

11. The floating modular breakwater system of claim 10, wherein each of the plurality of floating modular breakwaters further includes:

at least one air line configured to selectively provide air to the at least one main float so as to displace water from the at least one main float;

at least one valve, attached to the at least one main float, configured to selectively allow air to be discharged from the main float; and at least one water inlet in the at least one main float, configured to allow water to enter the float when air is discharged, such that the at least one main float may be selectively sank or raised on command.

12. The floating modular breakwater system of claim 10, wherein the at least one main float of each of the plurality of floating modular breakwaters comprises at least two main floats, each of the plurality of floating modular breakwaters further includes:

a longitudinal main frame, coupled to the at least two main floats, supporting the plurality of pivoting parallel slats the main frame, each of the at least two main floats located on a corresponding end of the longitudinal main frame; and a plurality of stabilizer lines, each connecting a corresponding one of the at least two main floats to one or more of the at plurality of parallel slats and configured to insure that when the at least two main floats are being filled with air, they keep these floats below the longitudinal main frame.

13. The floating modular breakwater system of claim 10, wherein the at least one main float of each of the plurality of floating modular breakwaters comprises at least two main floats, each of the plurality of floating modular breakwaters further includes:

a longitudinal main frame, coupled to the at least two main floats, supporting the plurality of pivoting parallel slats the main frame, each of the at least two main floats located on a corresponding end of the longitudinal main frame.

14. The floating modular breakwater system of claim 11, wherein the at least one main float of each of the plurality of floating modular breakwaters comprises at least two main floats, each of the plurality of floating modular breakwaters includes:

a longitudinal main frame, coupled to the at least two main floats, supporting the plurality of pivoting parallel slats the main frame, each of the at least two main floats located on a corresponding end of the longitudinal main frame.

15. The floating breakwater system of claim 14, wherein each of the plurality of floating modular breakwaters further includes:

at least one stabilizer float, coupled to a center portion of the longitudinal main frame configured to hold the longitudinal main frame in a horizontal position when the breakwater is being sunk from a floating position or raised from a submerged position.

16. The floating breakwater system of claim 6, wherein each of the plurality of floating modular breakwaters further includes an air system for filling and emptying the stabilizing float and the at least two main floats, the air system comprising:

one or more pressurized air tanks;

the at least one valve includes a dual position valve, where one position allows the entrance of air from the pressurized tanks to the stabilizing float and the other position allows air to out from the stabilizing float to the environment, the at least one valve located at a highest point of the stabilizing float;

air flow connection lines extending from the pressurized tanks to the dual position valve at the top of the stabilizing float; and air-water flow connection lines extending from a lower position of the stabilizing float to top positions of the at least two main floats.

17. The floating breakwater system of claim 13, wherein each of the plurality of floating modular breakwaters further includes:

a release mechanism, securing the plurality of pivoting parallel slats in a retracted position beneath the main frame, and configured to release the plurality of pivoting parallel slats, such that when the release mechanism is activated, the plurality of parallel slats extend downward from the main frame under influence of gravity.

18. The floating breakwater system of claim 10, wherein the plurality of parallel slats in each of the plurality of floating modular breakwaters further includes:

a plurality of holes in slats allowing water to pass through when the breakwater is on a wave crest and the plurality of parallel slats are closed, configured such that water passing through the plurality of holes will experience turbulence therefore lowering the kinetic energy of the wave in the direction of the wave.

* * * * *